US011045965B2

(12) United States Patent
Galanis et al.

(10) Patent No.: US 11,045,965 B2
(45) Date of Patent: Jun. 29, 2021

(54) SHAVING CARTRIDGE INCLUDING A MASKING FOIL

(71) Applicant: Bic Violex S.A., Attiki (GR)

(72) Inventors: Christos Galanis, Agia Paraskevi (GR); Dimitrios Efthimiadis, Athens (GR); Christoforos-Athanasios Brellis, Neapoli (GR); Ioannis Malliaros, Athens (GR); Maria Petratou, Maroussi (GR); Anestis Tsegenidis, Maroussi (GR); Panagiotis Moustakas, Athens (GR); Vasileios Papachristos, Zografou (GR)

(73) Assignee: Bic Violex S.A., Anoixi (GR)

( * ) Notice: Subject to any disclaimer, the term of this patent is extended or adjusted under 35 U.S.C. 154(b) by 0 days.

(21) Appl. No.: 16/310,235

(22) PCT Filed: Jul. 27, 2017

(86) PCT No.: PCT/EP2017/069062
§ 371 (c)(1),
(2) Date: Dec. 14, 2018

(87) PCT Pub. No.: WO2018/019953
PCT Pub. Date: Feb. 1, 2018

(65) Prior Publication Data

US 2020/0009753 A1 Jan. 9, 2020

Related U.S. Application Data

(60) Provisional application No. 62/367,787, filed on Jul. 28, 2016.

(30) Foreign Application Priority Data

Jul. 28, 2016 (WO) ..... PCT/EP2016/068017

(51) Int. Cl.
*B26B 21/40* (2006.01)
*B26B 21/44* (2006.01)
*B26B 21/22* (2006.01)

(52) U.S. Cl.
CPC ..... *B26B 21/4006* (2013.01); *B26B 21/4037* (2013.01); *B26B 21/4068* (2013.01);
(Continued)

(58) Field of Classification Search
CPC ..... B26B 21/4006; B26B 21/4037; B26B 21/4068; B26B 21/44; B26B 21/225; B26B 21/4031; B26B 21/4087; B26B 21/446
(Continued)

(56) References Cited

U.S. PATENT DOCUMENTS 4,914,817 A * 4/1990 Galligan ..... B26B 21/4006 30/346.58
5,630,275 A * 5/1997 Wexler ..... B26B 21/22 30/346.53
(Continued)

FOREIGN PATENT DOCUMENTS

AT 007 252 U1 12/2004
FR 2 559 657 A1 12/1987
(Continued)

OTHER PUBLICATIONS

International Search Report dated Nov. 15, 2017, in International Application No. PCT/EP2017/069057 (4 pages).

*Primary Examiner* — Hwei-Siu C Payer
(74) *Attorney, Agent, or Firm* — Bookoff McAndrews, PLLC

(57) ABSTRACT

A masking foil, for a shaving cartridge, and a shaving cartridge comprising a housing having a top surface, a bottom surface, a front edge, a rear edge, and a pair of side
(Continued)

edges extending between the front edge and the rear edge. The housing includes a main blade disposed between the front edge and the rear edge. The main blade includes a main cutting edge extending toward the top surface and is movable in the housing. The shaving cartridge further comprises a masking foil. The masking foil includes a front portion located forward of the main cutting edge, a back portion located rearward the main cutting edge, and at least one ribbon which extends between the front portion and the back portion and which partially covers the main cutting edge.

19 Claims, 18 Drawing Sheets

(52) U.S. Cl.
CPC ..... *B26B 21/44* (2013.01); *B26B 21/225* (2013.01); *B26B 21/4031* (2013.01); *B26B 21/4087* (2013.01); *B26B 21/446* (2013.01)

(58) Field of Classification Search
USPC ..... 30/41, 41.5, 50
See application file for complete search history.

(56) References Cited

U.S. PATENT DOCUMENTS

| | | | | |
|---|---|---|---|---|
| D524,483 | S | 7/2006 | Bunnell et al. | |
| D526,089 | S | 8/2006 | Fischer et al. | |
| 8,015,710 | B1 | 9/2011 | Zyla | |
| 10,786,914 | B2 * | 9/2020 | Galanis | B26B 21/4006 |
| 2001/0054235 | A1 | 12/2001 | Saito | |
| 2010/0024615 | A1 | 2/2010 | Rebaudieres et al. | |
| 2012/0324737 | A1 * | 12/2012 | Howell | B26B 21/4031 30/50 |
| 2015/0158190 | A1 * | 6/2015 | Georgakis | B26B 21/4068 30/50 |
| 2018/0169879 | A1 * | 6/2018 | Psimadas | B26B 21/42 |
| 2019/0118397 | A1 * | 4/2019 | Drori | B26B 21/4037 |
| 2019/0255720 | A1 * | 8/2019 | Galanis | B26B 21/4006 |
| 2020/0009753 | A1 * | 1/2020 | Galanis | B26B 21/4068 |
| 2020/0338770 | A1 * | 10/2020 | Moustakas | B26B 21/443 |

FOREIGN PATENT DOCUMENTS

| | | | |
|---|---|---|---|
| FR | 2599657 | A1 | 12/1987 |
| GB | 2461337 | A | 1/2010 |
| WO | 97/33728 | A1 | 9/1997 |
| WO | 0107214 | A1 | 2/2001 |
| WO | 01/71214 | A1 | 9/2001 |
| WO | 2007/147420 | A1 | 12/2007 |
| WO | 2014/119808 | A1 | 8/2014 |

* cited by examiner

SHAVING CARTRIDGE INCLUDING A MASKING FOIL

CROSS REFERENCE TO RELATED APPLICATION

This application is a National Stage application of International Application No. PCT/EP2017/069062, filed on Jul. 27, 2017, and published as WO2018/019953 on Feb. 1, 2018, which claims priority to International Application No. PCT/EP2016/068017, filed on Jul. 28, 2016, and U.S. Provisional Application No. 62/367,787, filed Jul. 28, 2016.

FIELD OF THE DISCLOSURE

The disclosure relates to shaving cartridges including a masking foil and such a masking foil. More precisely, the disclosure relates to shaving cartridges including a housing, one or more blade(s) having a blade edge and a masking foil or blade shield that partially covers the blade edge(s).

BACKGROUND OF THE DISCLOSURE

Typically, shaving cartridges include multiple guard members disposed across the razor blade edges. These members can act as blade shields to control the skin profile during shaving. However, this type of guard member is not satisfactory because assembly on a shaving cartridge is difficult and the shaving performance is not efficient enough. Furthermore, this type of guard member is not suitable to a shaving cartridge including movable blades.

Therefore, the known blade shields do not provide comfort and easy to glide movement in shaving while being easy to mount in a shaving cartridge with movable or unmovable blades.

SUMMARY OF THE DISCLOSURE

Accordingly, in examples, disclosed are shaving cartridges having a blade shield that provides added protection for the skin during shaving by improving the sliding surface in contact with the skin, while increasing comfort in shaving and glideness. The blade shield also provides a hair alignment that decreases the hair-cutting force.

To this end, according to the disclosure, the shaving cartridge may comprise a housing having a top surface, a bottom surface, a front edge, a rear edge, and a pair of side edges extending between the front edge and the rear edge, the housing having a main blade disposed between the front edge and the rear edge, the main blade having a main cutting edge extending toward the top surface, the main blade being movable in the housing, wherein the shaving cartridge may comprise a masking foil comprising a front portion located forward of the main cutting edge and a back portion located rearward the main cutting edge, the masking foil further comprising at least one ribbon which partially covers the main cutting edge, wherein the main blade is movable in the housing.

The shaving cartridge according to the disclosure may create a special skin sliding surface that alters the skin flow before the cutting edge.

In various examples of the disclosure, one and/or the other of the following features may be incorporated in the shaving cartridge of the disclosure, alone or in mutual combination:

- the masking foil may comprise an elastic means. Therefore, the elastic means of the masking foil may allow to the masking foil to follow the movement of the movable blade.

- the masking foil may comprise at least one securing portion, the securing portion being placed on the main blade, toward the top surface and close to one of the pair of side edges. This securing portion of the masking foil may be in position for proper assembly into the cartridge.
- at least one additional blade, the at least one additional blade having an additional cutting edge, wherein the at least one ribbon partially may cover both the main cutting edge and the at least one additional cutting edge, and wherein the securing portion may be placed on the main blade and the at least one additional blade, toward the top surface and close to one of the pair of side edges.
- the at least one ribbon partially may cover the main cutting edge and uncovers the at least one additional cutting edge.

In this way, the uncovered blade may increase shaving efficiency and the covered blade may alter the exposure of the subsequent uncovered blade. Therefore, the shaving cartridge can have two different shaving geometries. In other words, a first shaving geometry corresponds to the uncovered blade(s). A second shaving geometry corresponds to the covered blade(s).

- the at least one ribbon may comprise bristles, the bristles being adapted for moving during shaving.
- the at least one ribbon can comprise extruded protrusions having a conical shape and ending with an aperture.
- the at least one ribbon can comprise pikes, which are oriented toward the top surface of the housing.
- at least one ribbon may comprise rounded protrusions facing toward the top surface of the housing.
- at least one ribbon may comprise at least one tip.
- at least one ribbon may comprise corrugations, each corrugation having an amplitude (A1, A2, A3, A4, A5) different from each other.
- at least one ribbon may comprise steps.
- at least one ribbon may comprise small barbs split into clumps along the at least one ribbon.
- a blade retainer and the securing portion which is disposed between the main blade and the blade retainer.
- the cartridge has a blade retainer comprising the securing portion of the masking foil.
- the securing portion is fixedly mounted in the side edge of the shaving cartridge.
- the at least one ribbon comprises a front bent portion connected to the front portion and a back bent portion connected to the back portion of the masking foil, the front and the back bent portion being directed toward the bottom surface. These bent portions provide a rigidity of the masking foil.
- the masking foil comprises more than one ribbon, the front bent portions of each ribbon being connected to a front anchorage area, and the back bent portions of each ribbon being connected to a back anchorage area.
- when the masking foil comprises an elastic means, this elastic means can be located between the anchorage area and at least one of the front or back bent portions of the ribbon. The anchorage area can also be fixed in the housing.
- the cutting edge coverage percentage of the at least one ribbon can be comprised between 1% and 70%. More precisely, the coverage percentage can be comprised between 5% and 20%.
- the shape of the surface of the at least one ribbon covering at least partially the main cutting edge can be planar, in a cross sectional view.

the at least one ribbon crosses the main cutting edge with an angle comprised between 15° and 90°. Thus, the ribbon can be perpendicular to the front portion and the back portion. The ribbon can also be oblique, converging, deflecting or curved with variable angles, which changes the interaction of the shaver head with the skin and can improve shaving comfort and reduce the skin friction. The above orientations alter the way that the shaver head interacts with the skin, thus improving skin management and shaving comfort and reducing the head to skin friction. For example, diverging ribbons may further stress the skin, creating thus a smoother skin terrain with less friction.

the at least one ribbon crosses the main cutting edge and at least one additional cutting edge with an angle comprised between 15° and 90°.

the masking foil can comprise a wound healing and/or an anti-bacterial agent, in order to enhance functionality of the masking foil. The masking foil can also comprise a lubricating coating, such as polyfluorocarbon. This coating may provide a reduction of the friction between the shaving cartridge and the skin.

Another object of the disclosure may be a masking foil, for a shaving cartridge manufactured by a method comprising the steps of: a) providing a flat strip of material, b) performing holes in the strip, c) forming the pattern of the masking foil; and d) forming a front bent portion and a back bent portion.

the masking foil can further comprise a material chosen among steel, stainless steel, plastic material, composite, aluminum, aluminum alloys and/or noble metals chosen among gold or platinum and/or other metallic material.

the masking foil can comprise different shapes in a cross-sectional view.

the masking foil can comprise different patterns.

The shaving cartridge can comprise two masking foils.

Another object of the present disclosure is a masking foil, for a shaving cartridge, comprising a front portion and a back portion and at least one ribbon extending between the front portion and the back portion, wherein the masking foil comprises an elastic means.

BRIEF DESCRIPTION OF THE DRAWINGS

Other characteristics and advantages of the disclosure will readily appear from the following description of one example, provided as non-limitative examples, in reference to the accompanying drawings.

In the different Figures, the same reference signs designate identical or similar elements.

DETAILED DESCRIPTION OF THE DISCLOSURE

The Figures illustrate different examples of a shaving cartridge 10 according to the disclosure, the shaving cartridge 10 comprising one or several blades 12 provided in a housing 13. The blade(s) 12 can be movably retained in the housing 13. The shaving cartridge 10 can be permanently or detachably attached to a razor handle 14. The shaving cartridge 10 can be pivotally or non-pivotally attached to the razor handle 14.

Figure 1:
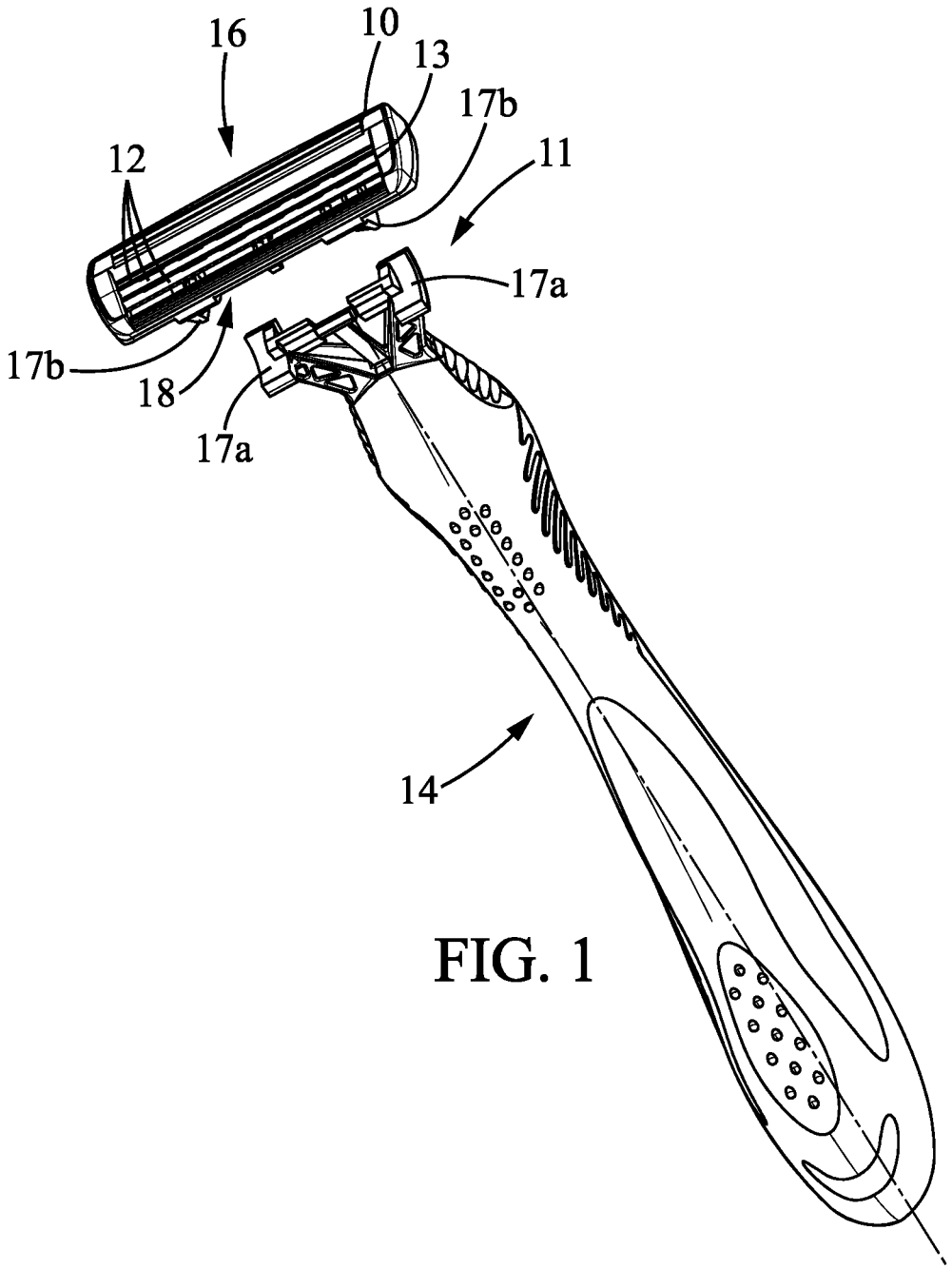
FIG. 1 is a perspective view of a wet shaving razor, comprising a shaving cartridge, according to the disclosure.

For instance, as illustrated in FIG. 1, the shaving cartridge 10 according to the disclosure may comprise three blades 12, but the disclosure may not be limited to said number of blades. The number of blades may however vary between one and six blades for instance. The shaving cartridge 10 can be connected to the razor handle 14 to form a wet shaving razor 11. As depicted in FIG. 1, the shaving cartridge 10 may be detachably connected to the handle 14 in order to be thrown when the blade edges are dulled.

As shown in FIG. 1, the bottom surface 18 of the shaving cartridge 10 may include two connecting members or rearwardly protruding connectors, i.e. two inwardly facing arcuate arms 17*a* shaped in correspondence with and adapted to receive lateral edges of shell bearing 17*b* provided onto the handle 14 for pivotally mounting the shaving cartridge 10 onto the handle 14.

Figure 2:
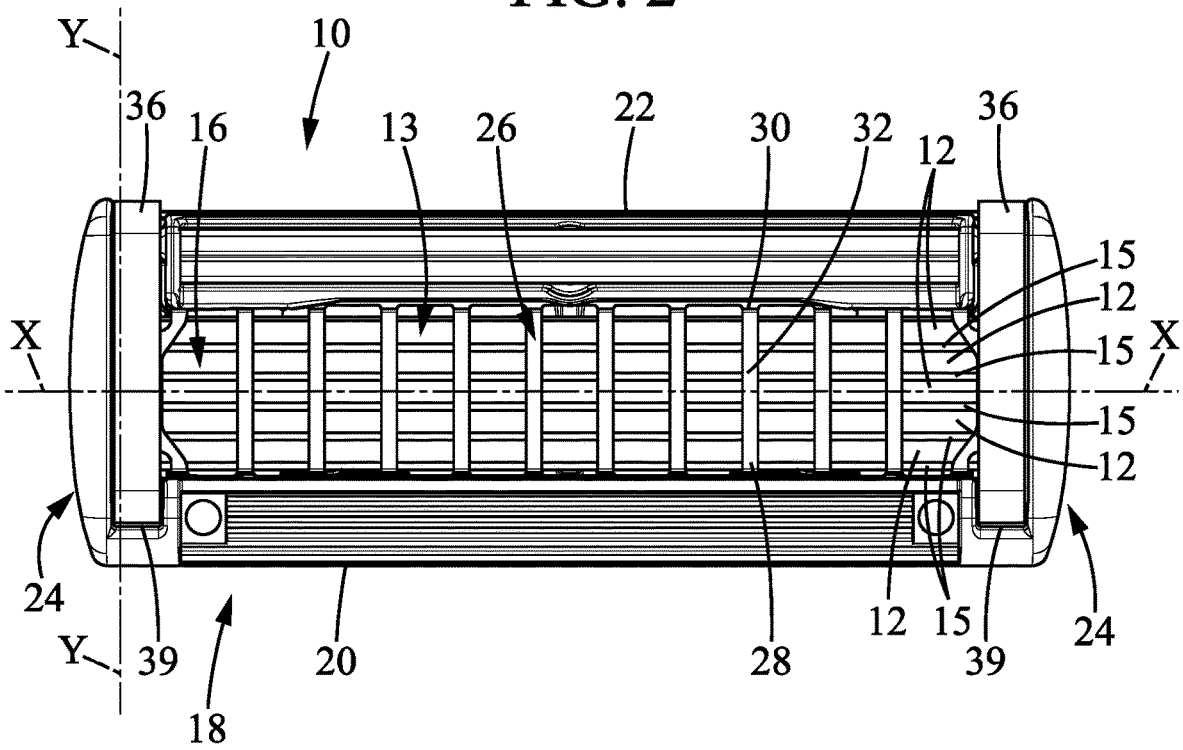
FIG. 2 is a top view of an example of the cartridge according to FIG. 1.
Figure 3:
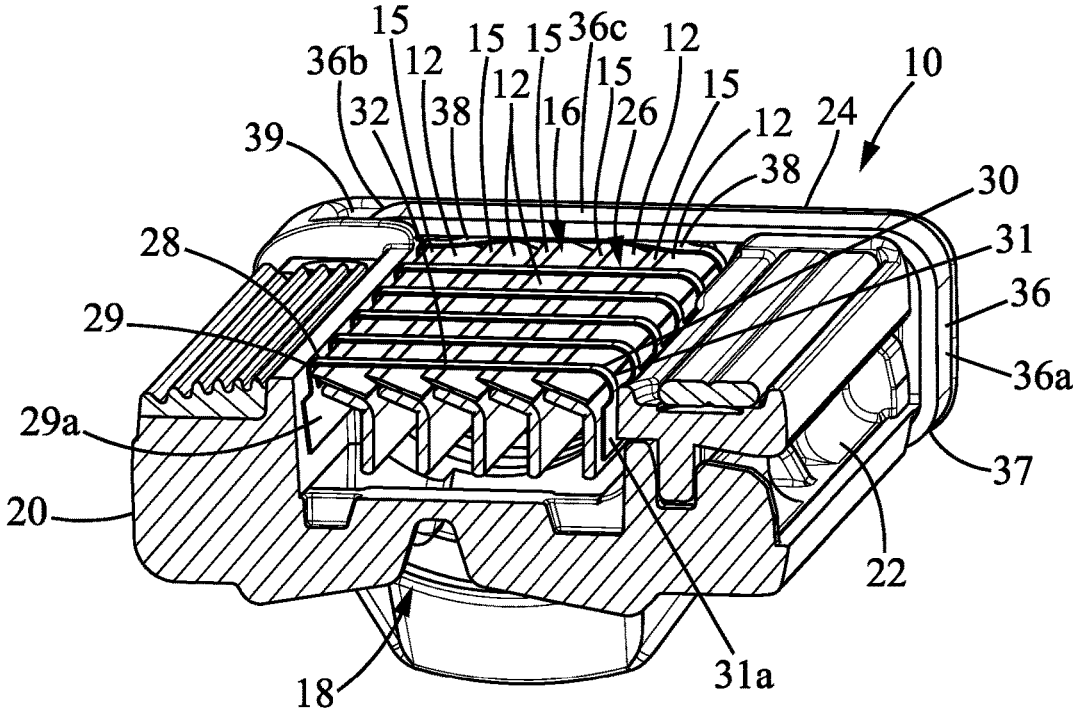
FIG. 3 is a cross-sectional perspective view of the cartridge of FIG. 2.

As best shown in FIGS. 2 and 3, the housing 13 may have a top surface 16, a bottom surface 18, a front edge 20, a rear edge 22, and a pair of side edges 24 extending between the front edge 20 and the rear edge 22. The housing 13 may comprise at least one blade 12 disposed between the front edge 20 and the rear edge 22. Each blade 12 may have a cutting edge 15 extending toward the top surface 16. The cutting edges 15 of the blades 12 can be parallel to an axis X-X.

Figure 4:
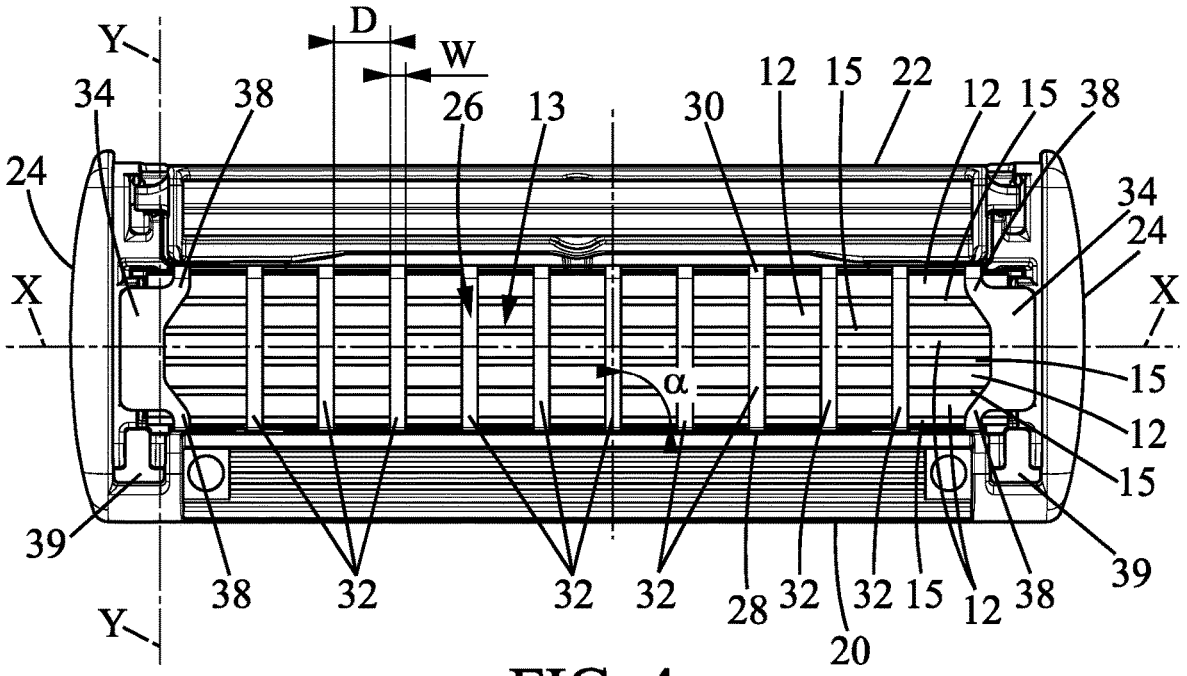
FIG. 4 is a top view illustrating an example of the securing portion of the cartridge of FIG. 2, the blade retainer being removed.

A masking foil 26 may cover partially the cutting edge 15 of one or more blade(s) 12. As depicted in FIGS. 3 and 4, the masking foil 26 may cover partially the cutting edge 15 of all the five blades 12.

Figure 5A:
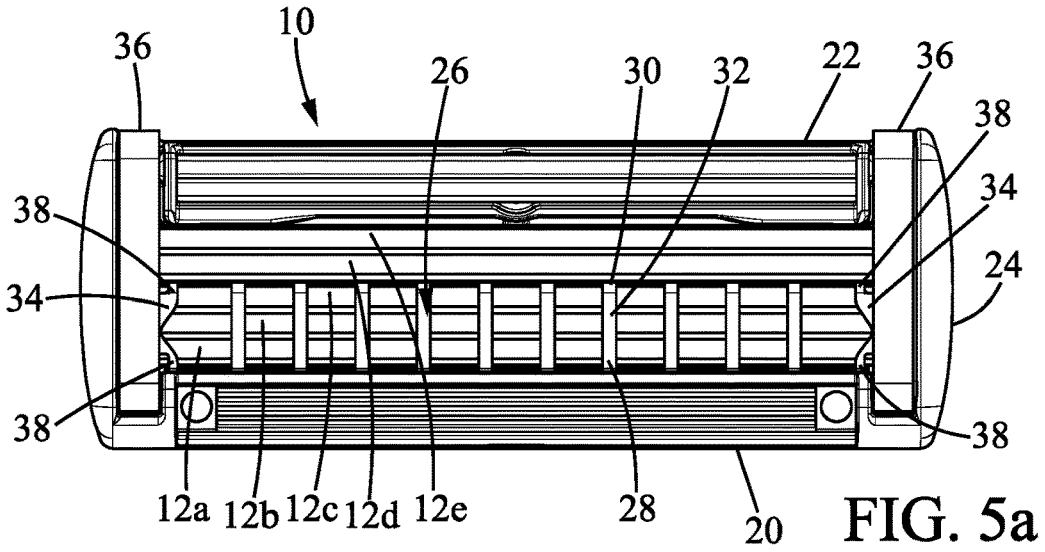
FIG. 5*a* is top view of another example of the shaving cartridge according to the disclosure.
Figure 6:
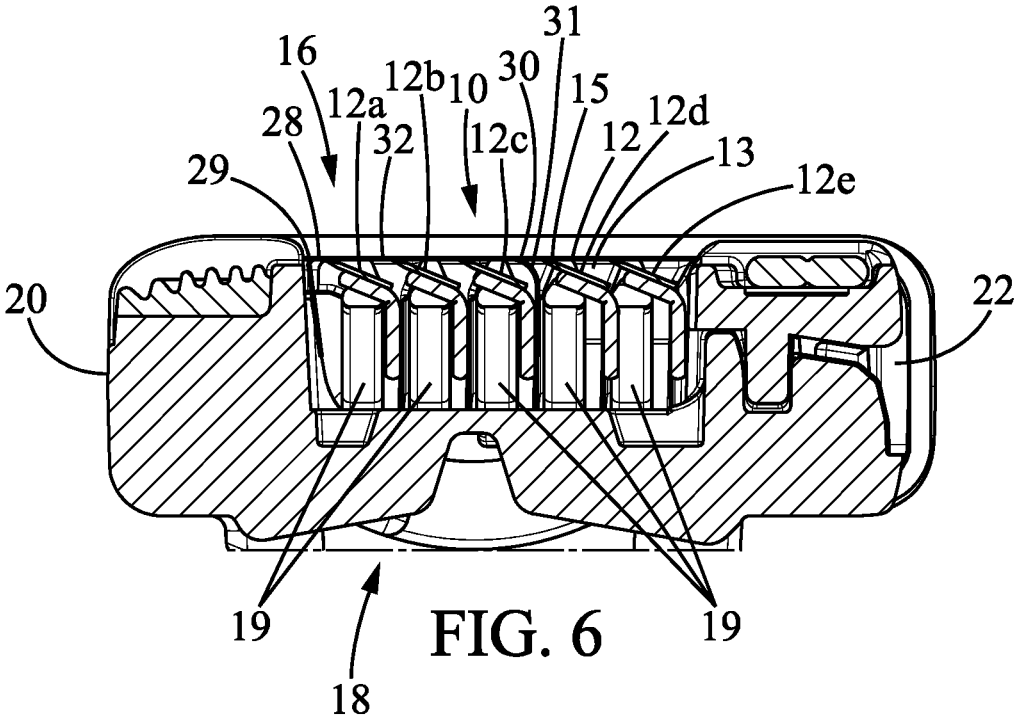
FIG. 6 is a cross-sectional view of the example of FIG. 5*a*.

In another example, as depicted in FIGS. 5*a* and 6, the masking foil may cover partially the cutting edge 15 of a main blade and at least one adjacent blade 12. In these figures, illustrating a shaving cartridge comprising five blades 12, only three adjacent blades 12*a*, 12*b*, 12*c* may be partially covered by the masking foil 26, on the side of the front edge 20. More precisely, the blade the closest to the front edge 20 may be the first blade 12*a*. In this configuration, the main blade may also be the first blade 12*a*. The second blade 12*b* may be the adjacent blade to the first blade 12*a*. Then the third blade 12*c* may be adjacent to the second blade 12*b*. The third blade 12*c* may also be the middle blade. The two other blades 12*d*, 12*e*, i.e. the two blades closest to the rear edge 22, may be uncovered by the masking foil 26. These two other uncovered blades 12*d*, 12*e*, on the side of the rear edge 22, may increase the shaving efficiency.

Figure 19:
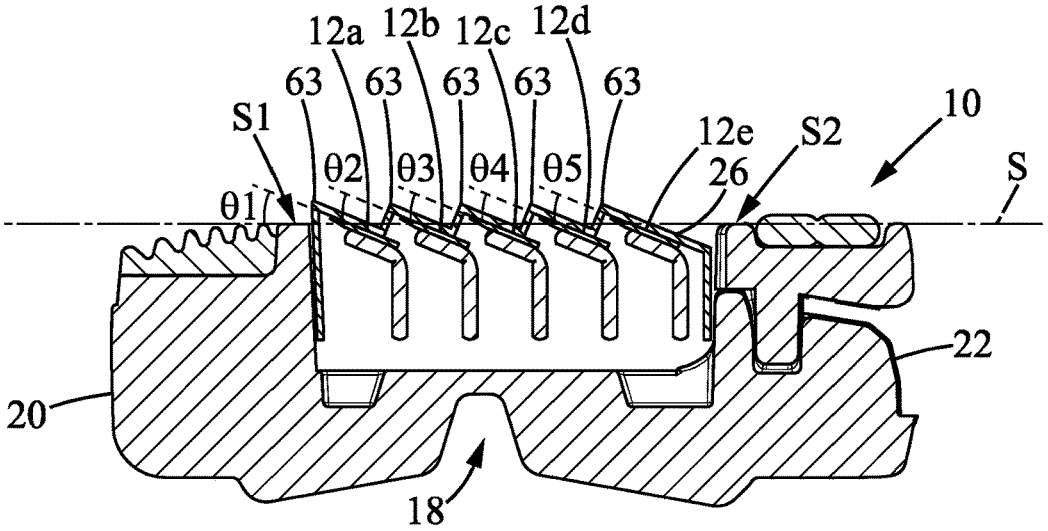

Indeed, the difference between a surface partially covered and a surface uncovered, i.e. without a masking foil 26, may cause two different exposures of the cutting edges 15. The exposure of the cutting edges 15 is the distance of the cutting edges 15 from the shaving plane S, as shown in FIG. 19. A shaving plane S may be defined as a plane comprising a surface S1 and a surface S2. The surface S1 may be located at the top surface 16 of the cartridge. In addition, the surface S1 may be located close to the front portion 28 of the masking foil 26. The surface S2 may be located at the top surface 16 of the cartridge. In addition, the surface S2 may be located close to the back portion 30 of the masking foil 26. This partial blade coverage may provide therefore two different shaving geometries. Thus, the shaving process and experience may be different than the ones with conventional wet shaving cartridges.

Figure 5B:
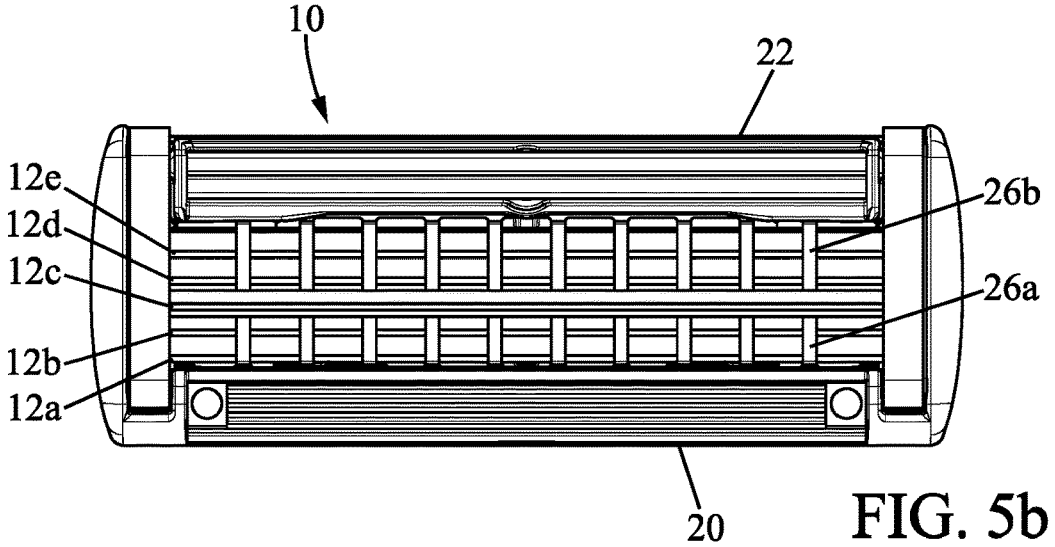
FIGS. 5*b* and 5*c* are top views of two other examples of the shaving cartridge according to the disclosure.

In another example, as depicted in FIG. 5*b*, the shaving cartridge 10 may comprise multiple masking foils 26. The multiple masking foils 26 can be separate by at least one blade 12. More precisely, as illustrated in FIG. 5*b*, a first masking foil 26*a* may cover partially the cutting edges 15 of the first blade 12*a* and the second blade 12*b*. A second masking foil 26*b* may cover partially the cutting edges 15 of the two blades 12*d*, 12*e* closest to the rear edge 22. The third blade 12*c* may be uncovered. The third blade 12*c* may also be located between the first masking foil 26*a* and the second masking foil 26*b*. The main blade of the first masking foil 26*a* may be the first blade 12*a*. The main blade of the second masking foil may be the forth blade 12*d*.

Figure 5C:
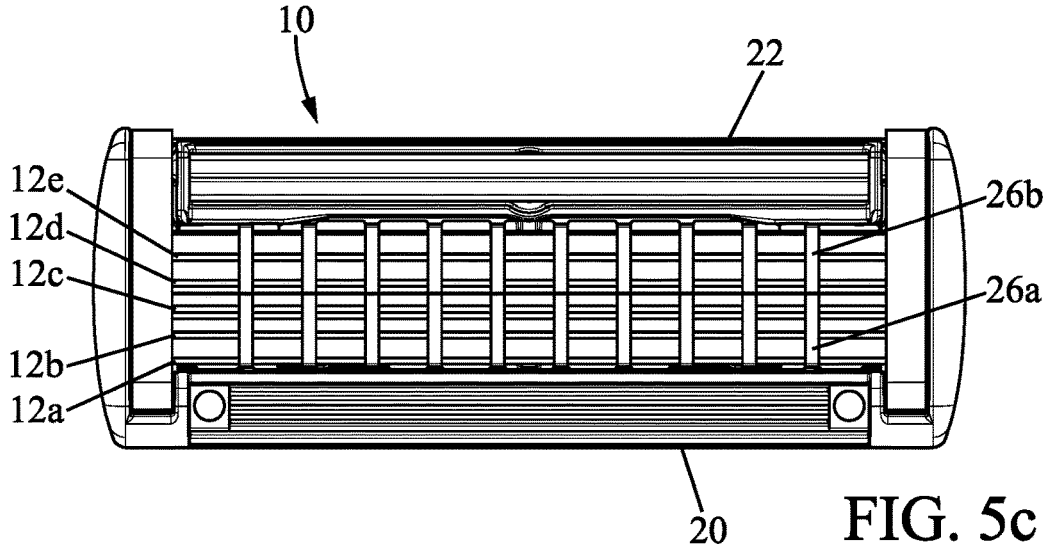

In FIG. 5*c*, the first masking foil 26*a* may cover partially the cutting edges 15 of the first, second a third blades 12*a*, 12*b* and 12*c*. The second masking foil may cover partially the two blades 12*d*, 12*e* closest to the rear edge 22. In another example, the third blade 12*c* could also be partially covered by the second masking foil 26*b* instead of the first masking foil 26*a*.

Therefore, any other combination with regard to the number of masking foil(s) used, the number of cutting edge(s) may be covered and the location of the masking foil(s) on the covered cutting edge(s) may be possible. In particular, one and/or the other of the following features may be incorporated in the shaving cartridge of the disclosure, alone or in mutual combination:

- The shaving cartridge 10 can comprise more than two masking foils 26, depending on the design of the shaving cartridge 10. For instance, the shaving cartridge can comprise three masking foils 26. The shaving cartridge 10 can also comprise one masking foil per blade, and/or
- Each cutting edge 15 can be partially covered by a masking foil 26, and/or
- The main blade can be anyone of the blades 12, and/or,
- All the cutting edges 15 can be partially covered by one sole masking foil 26.

The masking foil 26 may comprise a front portion 28 and a back portion 30 and at least one ribbon 32 extending between the front portion 28 and the back portion 30.

When the masking foil 26 covers each cutting edge 15, the front portion 28 may be located on the side of the front edge 20 and the back portion 30 may be located on the side of the rear edge 22.

As illustrated in FIG. 4, the masking foil 26 of the disclosure can further comprise at least one securing portion 34. Actually, the masking foil 26 can comprise two securing portions 34. Each of the two securing portions 34 may be placed close to the corresponding side edge 24.

Figure 7:
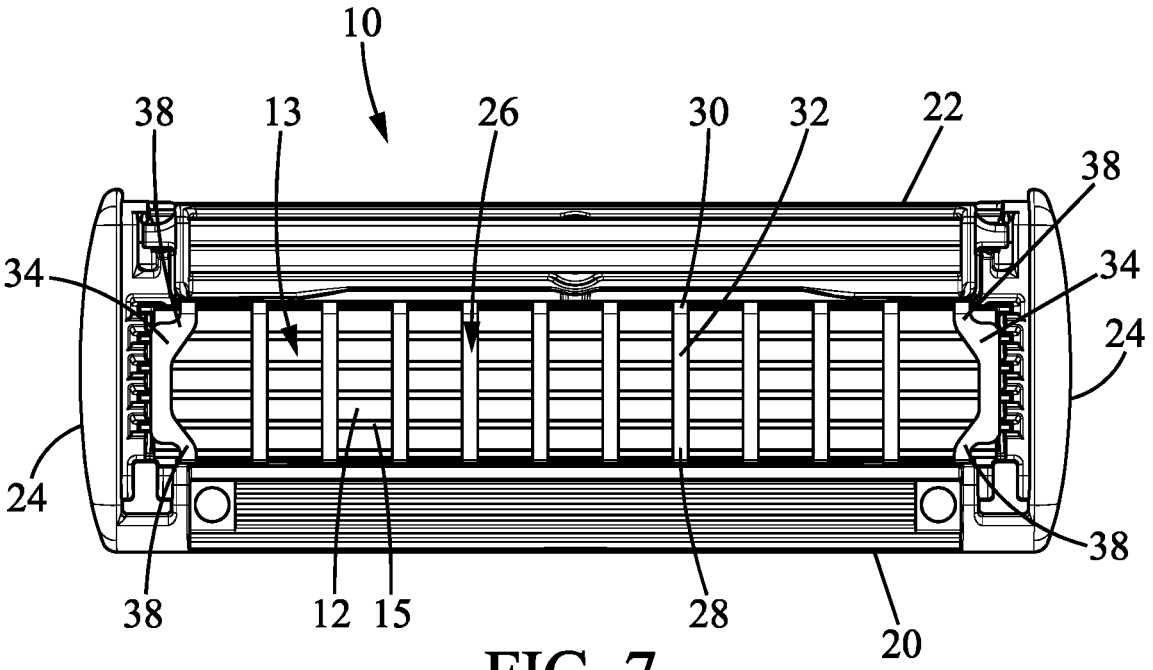
FIG. 7 is a top view illustrating the securing portion of the cartridge of FIG. 2, the blade retainer being removed.
Figure 8:
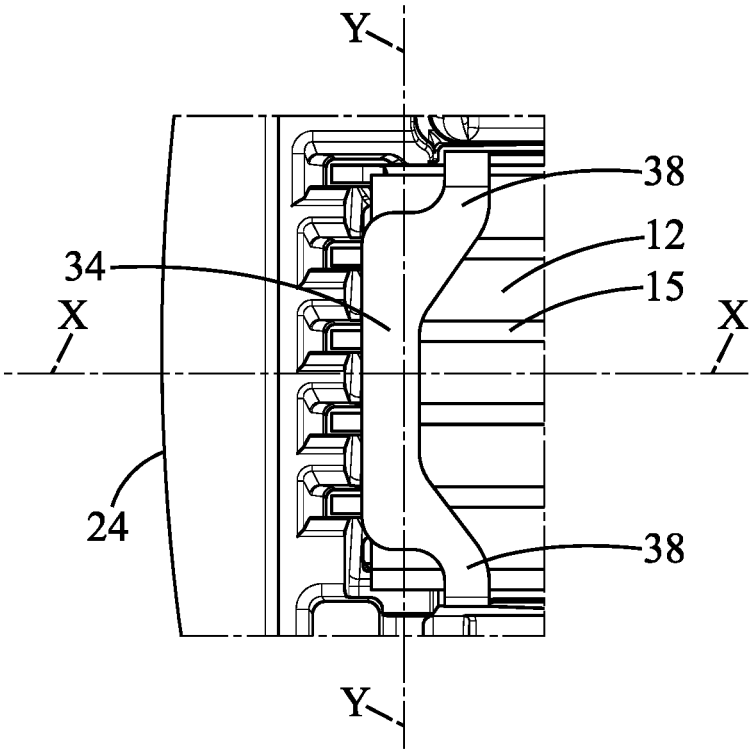
FIG. 8 is a detailed partial top view illustrating the securing portion of the cartridge of FIG. 2, the blade retainer being removed.

The shaving cartridge 10 can further may comprise a blade retainer 36 as visible on FIGS. 2, 3, 5 and 6 for instance. The blade retainer 36 may cover the blades 12 in order to retain the blades 12 in the housing 13. The blade retainer 36 may be placed at one end of the blades 12, close to the side edge 24. The blade retainer 36 may extend further between the front edge 20 and the rear edge 22 of the cartridge 10. The blade retainer 36 may comprise a first leg 36*a*, a second leg 36*b* and a body 36*c*. The body 36*c*, first leg 36*a* and second leg 36*b* form a one-piece part. Each leg 36*a*, 36*b* may extend to an end 37. The first leg 36*a* of the blade retainer surrounds the side edge 24 of the housing 13, on the side of the rear edge 22. In other words, a portion of the blade retainer 36 may be wrapped around a portion of the housing 13. The second leg 36*b* of the blade retainer 36 may be received in a through hole 39 provided in the housing 13. The through hole 39 may extend transversally through the housing 13 between the top surface 16 and the bottom surface 18. The cartridge 10 can further comprise two blade retainers 36. As shown in FIGS. 2 and 5 the two blade retainers 36 can be additional members, or as depicted in FIGS. 4, 7 and 8, the two securing portions 34 mounted on the housing 13 can act as blade retainers. The two securing portions 34 in the example of FIGS. 4, 7 and 8 may be attached in the housing 13, thanks to elasticity of the materials of the masking foil 26 and the cartridge 13. More precisely, the two securing portions 34 may be attached in the walls of the housing 13. For example, the masking foil 26 may be press fitted in the housing. The masking foil 26 can also be snap fitted, welded or inserted in the housing 13 of the cartridge 10. The masking foil 26 can also be molded with the material of the cartridge 10.

As shown in FIG. 4, each securing portion 34 may be placed between the cutting edges 15 of the blades 12 and a blade retainer 36 (not shown in FIG. 4), securing thus the position along X axis of the masking foil 26 onto the cartridge 10. As shown in FIG. 2, each blade retainer 36 may cover a corresponding securing portion 34 that may be placed between the blade retainer 36 and the cutting edges 15 of the blades 12. Actually, each securing portion 34 may be sandwiched between the blade retainer 36 and the blades 12. The securing portion 34 may have for example a rectangular shape, like a strip. Its shape may generally be identical to the body 36*c* of the blade retainer 36, which may cover the securing portion 34. Therefore, the body 36*c* and the securing portion 34 may have approximatively the same length and width in a top view. The securing portion 34 covers the blades 12 along a transversal axis Y-Y from the front edge 20 to the rear edge 22 of the cartridge 13. The transversal axis Y-Y can be perpendicular to the axis X-X that is parallel to the blade edge(s).

Each securing portion 34 may also have two joining members 38. Each joining member 38 may join respectively the front portion 28 of the masking foil 26 and the back portion 30 of the masking foil 26. The joining member 38 may allow a connection between the securing portion 34 and the remaining members of the masking foil 26.

Coming back to FIG. 3, the masking foil 26 may comprise at least one ribbon 32. In FIG. 4, the masking foil 26 may comprise ten ribbons 32, but the disclosure may not be limited to said number of ribbons. The cutting edge 15 of each blade 12 may be covered on an area corresponding to a ribbon 32 placed above this area. If no ribbon 32 is placed above the cutting edge 15, the cutting edge may not be covered on this area. Therefore, if the masking foil 26 comprises only one ribbon 32, the cutting edge 15 may comprise only one covered area and two uncovered areas. If the masking foil 26 comprise ten ribbons 32, the cutting edge 15 may comprise ten covered areas and eleven uncovered areas. Thus, the cutting edge 15 may comprise as much covered areas as the number of ribbons 32 on the masking foil 26. When the covered areas are not on an extreme location of the cutting edge 15, then the number of uncovered area may be of one more than the number of covered areas.

Each ribbon 32 may extend transversally between the front portion 28 and the back portion 30 of the masking foil 26. An angle $\alpha$, view from the top as shown in FIG. 4, can define the inclination of each ribbon between the axis X-X and the ribbon 32. This angle $\alpha$ can be comprised between 45° and 90° and can vary from one ribbon to another one on the same masking foil. More particularly, the angle $\alpha$ can be comprised between 15° and 90°. As illustrated in FIG. 4, the angle $\alpha$ may be approximatively 90°.

Each ribbon 32 may be connected to a front anchorage area 29*a* via a front bent portion 29 and to a back anchorage area 31*a* via a back bent portion 31 as visible for instance in FIG. 3. These two bent portions 29, 31 may provide rigidity to the ribbons 32 when shaving. Each anchorage area 29*a*, 31*a* may be directed toward the bottom surface 18 of the housing, approximatively along a transversal axis Z-Z from the top surface 16 to the bottom surface 18 of the cartridge 13. Each anchorage area 29*a*, 31*a* may be in an extension of the respective bent portion 29, 31. The anchorage areas 29*a*, 31*a* may not be attached. Thus, when the shaving cartridge 10 comprises movable blades 12, the geometry of the masking foil 26 may allow the movements of the masking foil 26 along with the movement of the movable blades 12. In other words, the masking foil 26 can be movable in the housing due to the forces applied by the skin and hair during shaving action. Therefore, in comparison with a masking foil which may not follow the movement of the blades 12, the masking foil 26 may increase the adaptability of the blades 12 and the shaving surface of the skin of the user which may be in contact with the masking foil 26. In addition, the blades 12 can move in the cartridge 10 without compromising the closeness during shaving action.

Figure 9A:
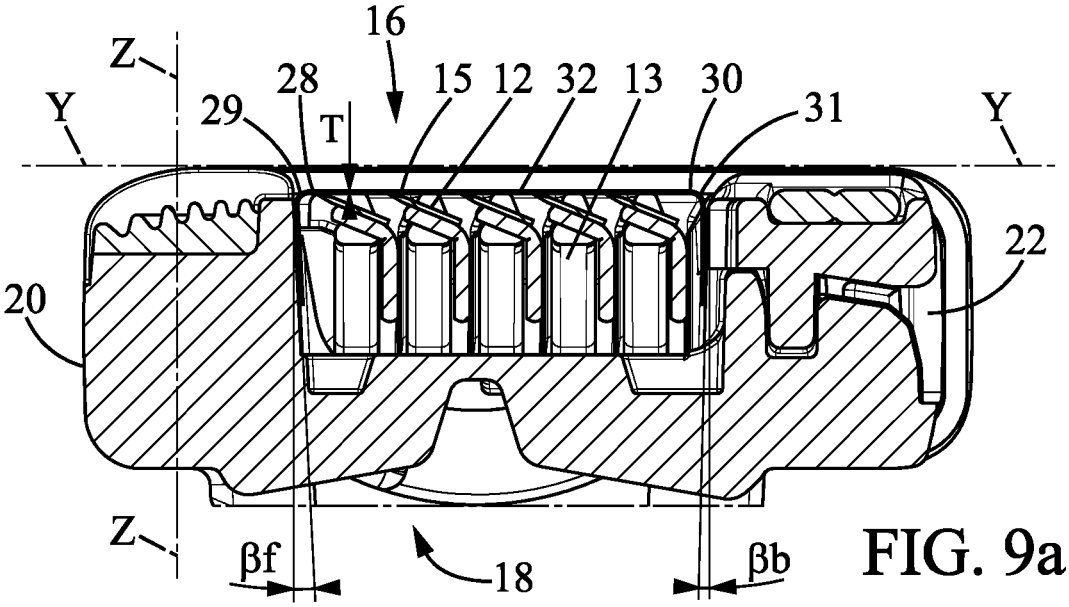
FIGS. 9*a*, 9*b*, 9*c* and 9*d* are cross-sectional views of different shape of the masking foil.

The front anchorage area 29*a* and the back anchorage area 31*a* each may make an angle with the axis Z-Z. The two angles can be equal or not. FIG. 9*a* shows the angle $\beta_b$ between the back anchorage area 31*a* and the axis Z-Z may be smaller than the angle $\beta_f$ between the front anchorage area 29*a* and the axis Z-Z. This difference may allow a facility assembly between the masking foil 26 and the cartridge 13. For example, the angle $\beta_f$ between the front anchorage area 29*a* and the axis Z-Z and the angle 4 between the back anchorage area 31*a* and the axis Z-Z may be comprised between 0° and 25°.

As depicted in FIG. 9*a*, the shape of the ribbon 32, in the covered area, may be flat viewed in a cross sectional view. Its thickness T may be measured along the axis Z-Z from the side of the top surface 16 to the side of the bottom surface 18. The thickness T can be comprised between 20 μm and 5000 μm. In particular, the thickness T may be comprised between 40 μm and 60 μm. The thickness T may be for example of about 50 μm.

Besides, the coverage percentage of the ribbons 32 can be comprised between 1% and 70%. In particular, the coverage percentage of the ribbons 32 may be comprised between 5% and 20%. For example, when the masking foil 26 comprises ten ribbons 32, the coverage percentage of the masking foil 26 by the ribbons 32 may be of about 20%. The ribbons 32 may be parallel to each other, transversally between the front portion and the back portion of the masking foil. The distance D between each ribbon may be defined as the perpendicular segment between the lateral sides of two adjacent ribbons 32. The width W of a ribbon 32 may be the distance between its two lateral sides. The distance D can be comprised between 3 mm and 3.25 mm. The width W can be comprised between 0.63 mm and 0.72 mm. Considering a cutting edge 15 with a length of about 34 mm and a masking foil 26 comprising ten ribbons 32, the distance D between each adjacent ribbon 32 would be of about 3.15 mm. In this case, the width W is 0.68 mm. The number of aperture, or i.e. uncovered area may be eleven.

FIGS. 9*a*, 9*b*, 9*c* and 9*d* illustrate different shapes of the masking foil 32, in view from a side edge.

In FIG. 9*a*, the shape of the ribbon 32 may be flat. The ribbon 32 may be substantially parallel all along the axis Y-Y. The ribbon 32 may rests on each cutting edge 15.

Figure 9B:
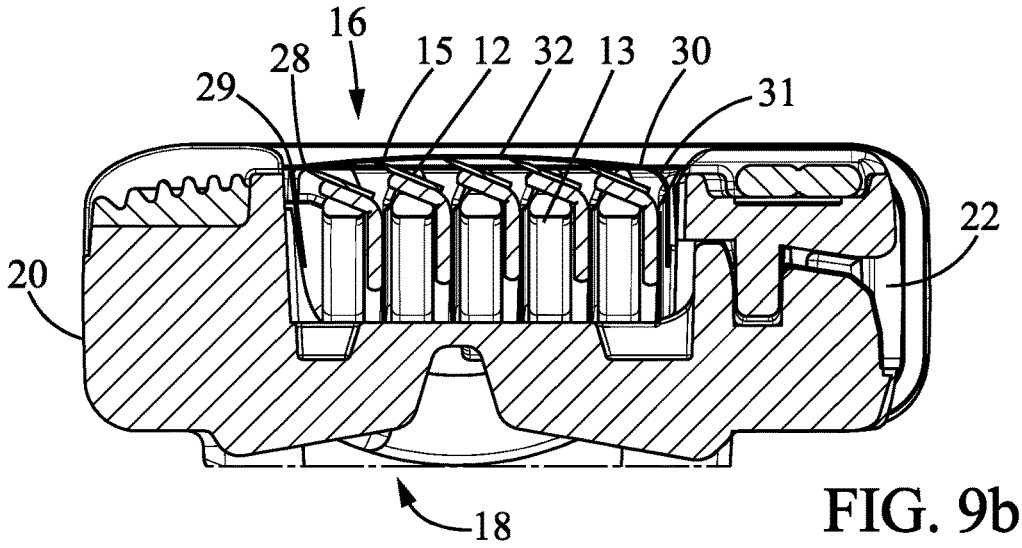

In FIG. 9*b*, the shape of the ribbon 32 may be curved. The cutting edge 15 may follow the shape of the masking foil 26, thus the cutting edges may have an exposure between −200 μm to +200 μm. For example, the curve can be a convex surface, according to axis Z-Z, from the bottom surface 18 to the top surface 16. The convex shape may provide a better accessibility in hard to reach anatomical regions. Thus, this shape may improve a shaving efficiency and precision.

Figure 9C:
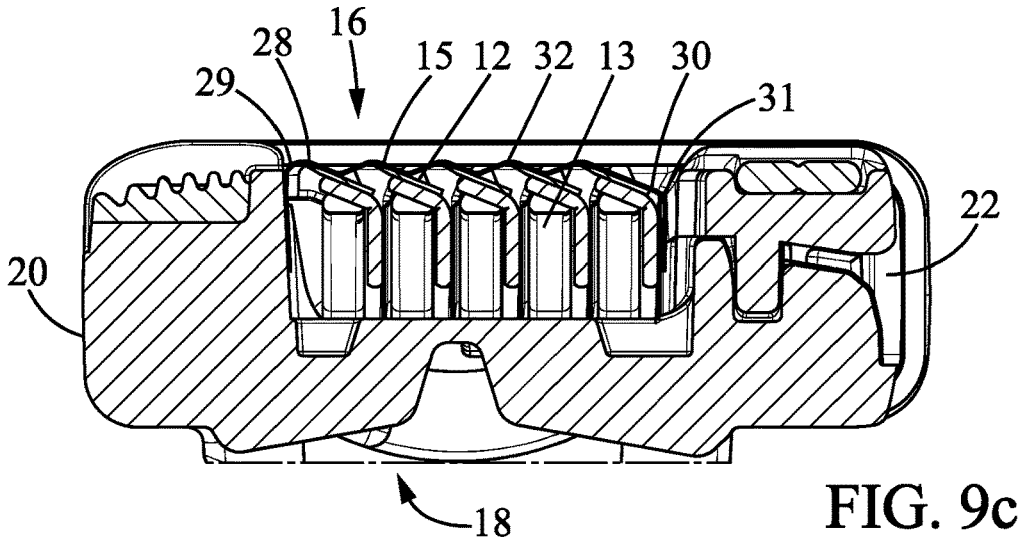

In FIG. 9*c*, the shape surface may be corrugated. Actually, the masking foil 26 follows the shape of the cutting edge 15 and a part of the blades 12. The corrugations may stabilize and/or regulate the exposure and/or the angle of each blade 12. The cutting edges may have an exposure between −200 μm to +200 μm. The blade angle may be the same, different or progressive. The corrugations may reduce the skin contact surface, thus reducing the shaving cartridge to skin friction.

Figure 9D:
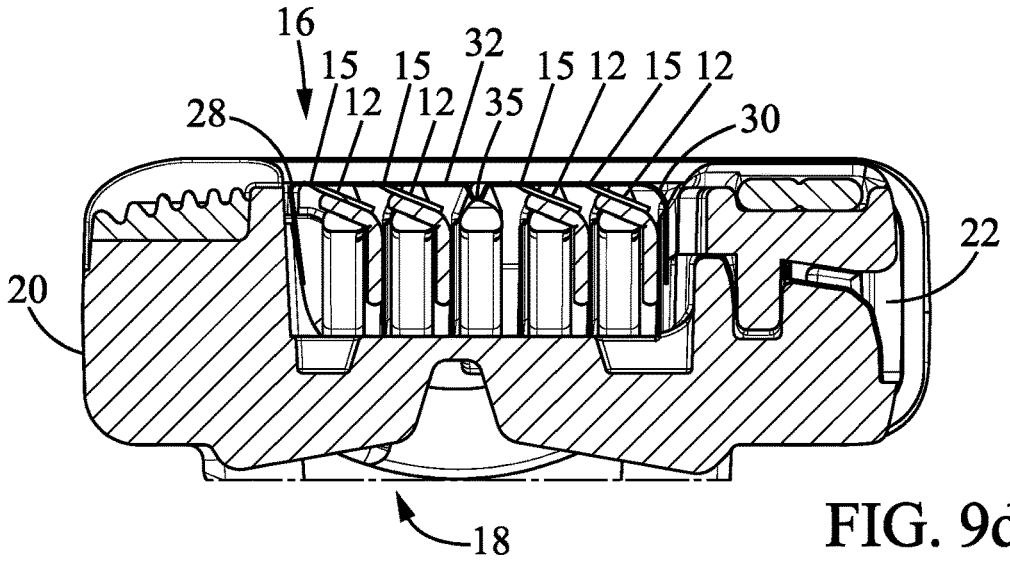

In FIG. 9*d*, the shape of the ribbon 32 may be partly flat, viewed in a cross sectional view. Indeed, the ribbon 32 may comprise a groove 35. The groove 35 may be disposed approximatively in the middle of the ribbon along its longitudinal axis. Any other combination, with regard to the number of groove 35 and its position on the masking foil 26, may be possible. In particular, one and/or the other of the following features may be incorporated in the shaving cartridge of the disclosure, alone or in mutual combination:

- The groove 35 is disposed closer to the front portion 28 than the back portion 30, or closer to the front portion 30 than the back portion 28 and/or,
- The masking foil can comprise two grooves 35 or more and/or,
- The masking foil comprising the groove(s) 35 can be used with the examples described above or below. For example, the shaving cartridge 10 may comprise multiple masking foils 26, each masking foil 26 comprising one groove 35.

Such shape surfaces may allow to manage the exposure of the blades with respect to a shaving plane. The cutting edges may have an exposure between −200 μm to +200 μm.

Figure 10A:
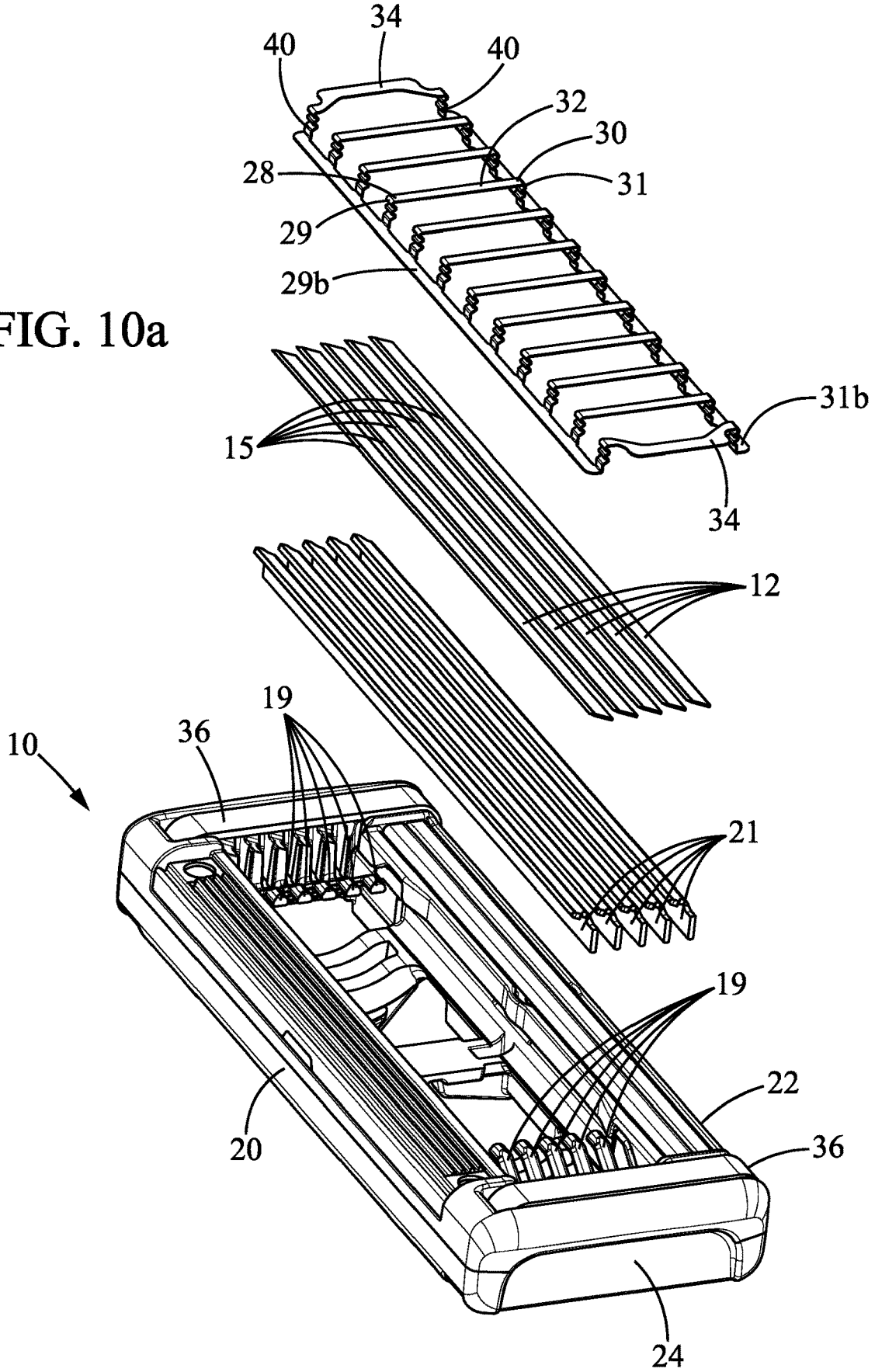
FIGS. 10*a* and 10*b* show respectively an exploded perspective view and a cross-sectional view of another example of the cartridge according to the disclosure.
Figure 10B:
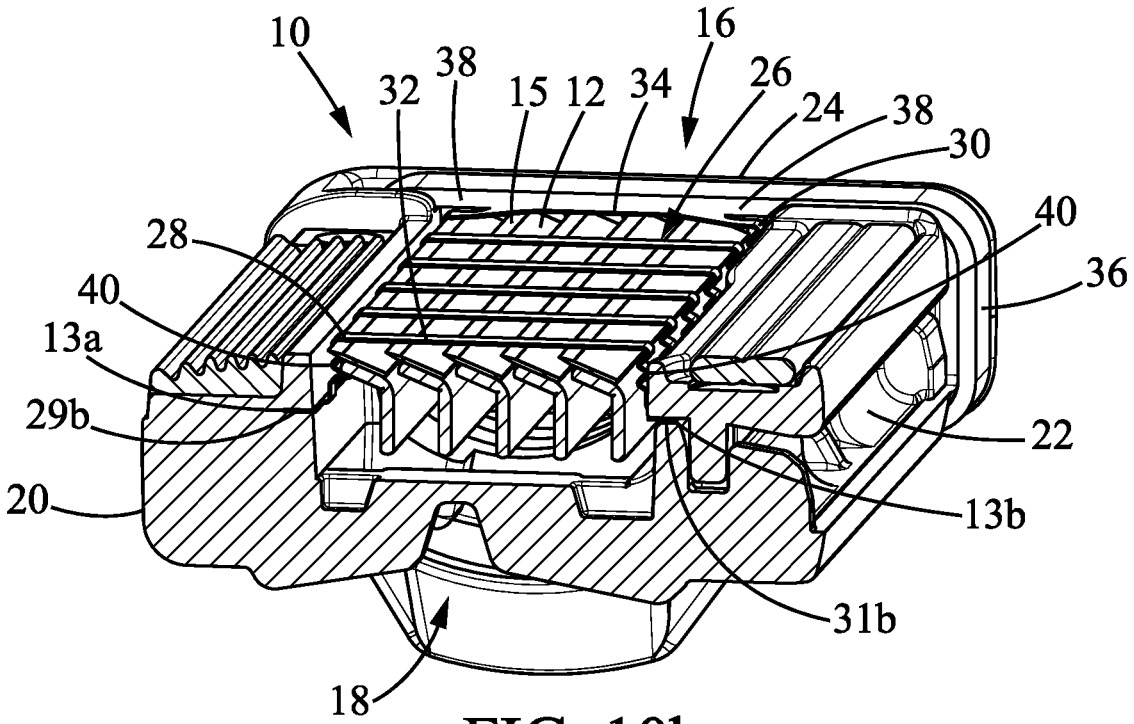
Figure 11:
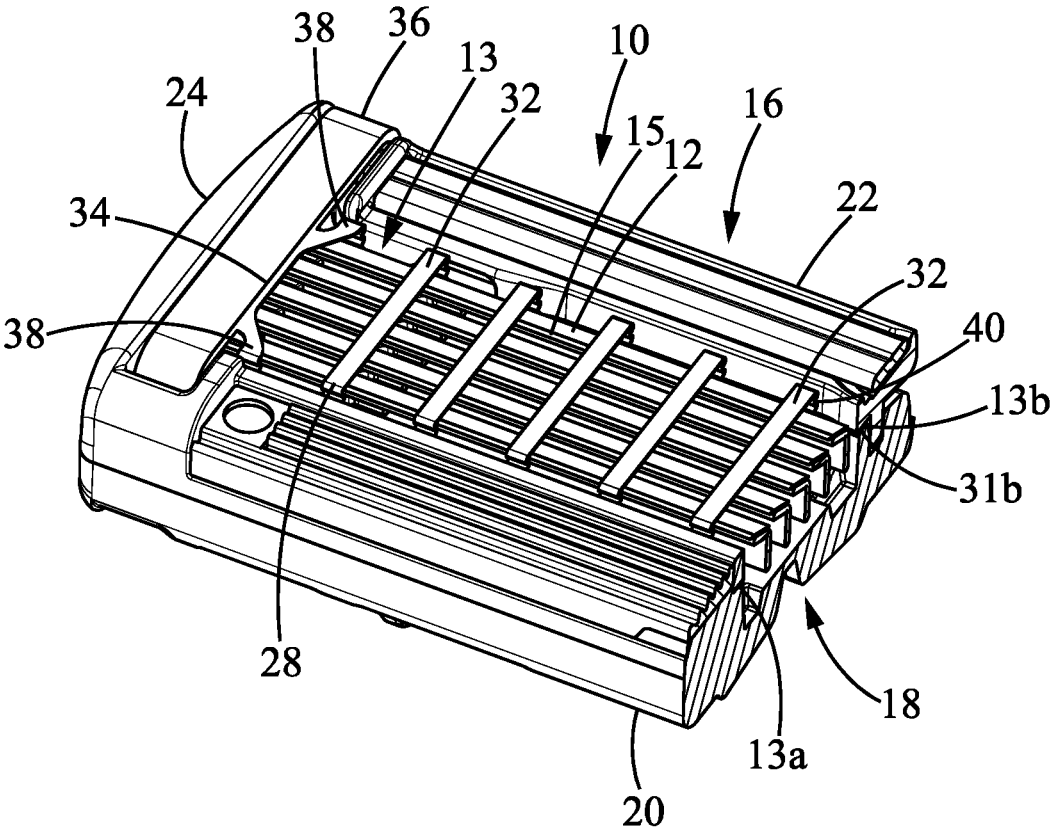
FIG. 11 is a cross-sectional in a perspective view of the cartridge of FIG. 10.

FIGS. 10*a*, 10*b* and 11 illustrate another example of the present disclosure where elastic means are further provided.

This example may be analogous to the example of FIG. 3, except an elastic means 40 may be provided with the masking foil 26 between the bent portion and the anchorage area of the masking foil 26 as visible in FIGS. 10*a* and 10*b*. Actually, an elastic means 40 can be provided on each side of a ribbon 32, between a bent portion and an anchorage area. Thus, an elastic means 40 can be placed between the front bent portion 29 and the anchorage area 29*b*. An elastic means 40 can also be provided on the masking foil 26 between the back bent portion 31 and the anchorage area 31*b*. In this example, the anchorage areas 29*b*, 31*b* may be attached in the housing 13 and can act as a blade retainer. Two slots 13*a*, 13*b* are provided in the housing 13. Each slot may be parallel to the top surface 16 or the bottom surface 18. Each slot may open outwardly the cartridge 13 and receives one of the two anchorage areas 29*b*, 31*b*.

The elastic means can be, for example, a spring. In that case, the material of the masking foil can be at least locally sufficiently elastic to allow an elastic deformation of the elastic means. It can also be made of multiple folds. Thus, the geometry of the masking foil 26 allows the movement of the masking foil 26 along with the movement of the movable blades 12 whereas the anchorage areas may be unmovable. Even if an elastic means 40 is particularly suitable for a shaving cartridge 10 with movables blades 12, this example can be used with non-movable blades 12.

Figure 10C:
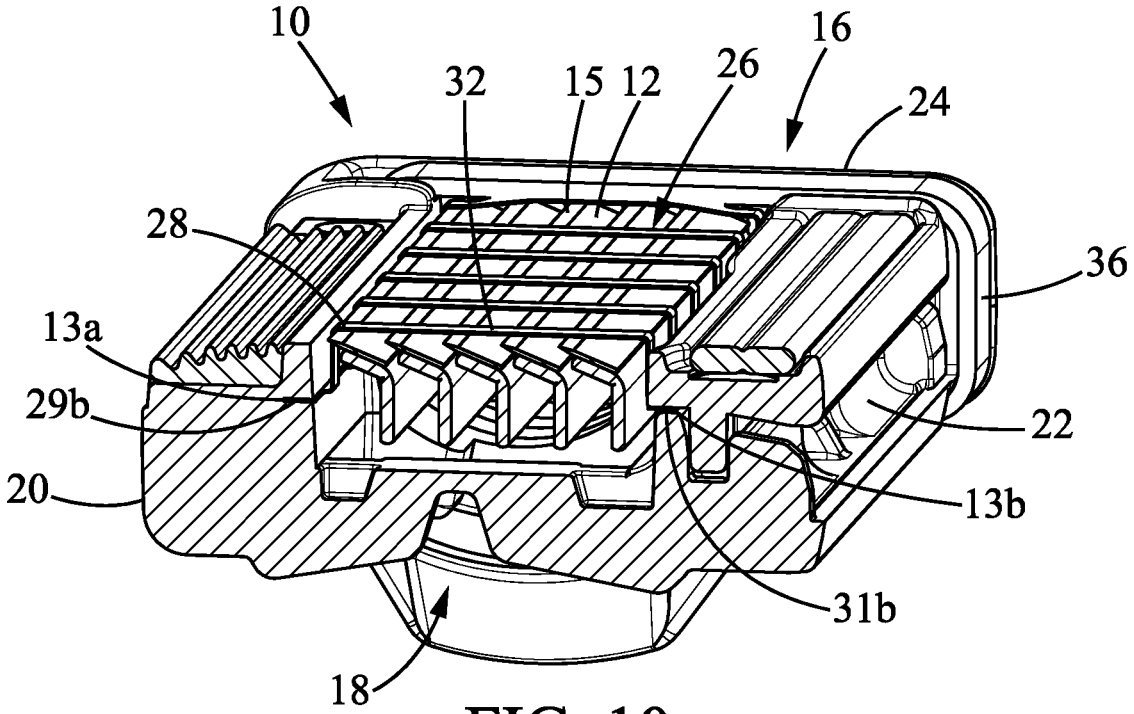
FIG. 10*c* shows a cross-sectional view of another example of the cartridge according to the disclosure.

Regardless the blades 12 may be movable or not, the masking foil 26 can be provided without the elastic means 40. For example, as depicted in FIG. 10*c*, the masking foil 26 may not be provided with the elastic means 40. However, the masking foil can comprise the anchorage areas 29*b*, 31*b*. The two anchorage areas 29*b*, 31*b* may also be attached in the housing 13 and can act as a blade retainer. Indeed, when the blades 12 are movable, the blades 12 can move toward the bottom surface 18 during shaving. When the blades 12 move toward the top surface 16 to return to their rest position (non-shaving), the movement of the blades may be stopped by stumbling against the masking foil 26. As depicted in FIG. 10*a*, each blade 12 may be borne by a bent support 21. In another aspects, not shown in the figures, the blade(s) may comprise a cutting edge portion, a base portion and a bent portion intermediate the cutting edge portion and the base portion, which may be integrally formed. In another aspect, not shown in the figures, the blade(s) may not be borne by a bent support 21 and be welded below the masking foil. Therefore, the masking foil 26 can act as a shield for the blades 12. Regardless of the elastic means 40, the masking foil 26 can also be elastically biased along with the movable blades 12. When the shaving cartridge 10 comprises also blade retainer 36, the blade retainer 36, together with the masking foil 26, may secure the blades 12 in the cartridge 10. In such configuration, i.e. where the blades 12 may be movable, the shaving cartridge 10 may comprise elastic fingers 19 (shown in FIGS. 6 and 10*a*). Such elastic fingers 19 are for example described in the publication WO2007147420 (in name of BIC VIOLEX). The movement of the masking foil 26 may be therefore indirectly managed by the elastic fingers 19.

FIGS. 12*a*, 12*b*, 12*c*, 12*d*, 12*e*, 12*f*, 12*g* and 12*h* illustrate different examples of possible pattern of the masking foil 26 where the angle α between the front portion 28 and the ribbon 32 may not be equal to 90°. FIG. 12*i* illustrates another example of possible pattern of the masking foil 26.

Figure 12A:
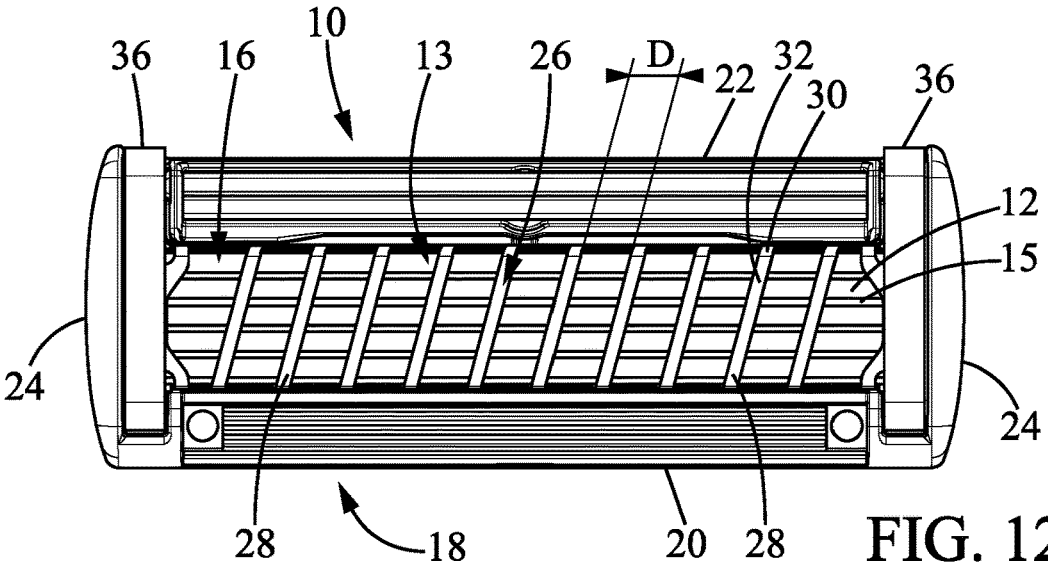
FIGS. 12*a*, 12*b*, 12*c*, 12*d*, 12*e*, 12*f*, 12*g*, 12*h*, 12*i* are illustrations of different masking foil patterns.

In FIG. 12*a*, all the ribbons 32 may be oriented in the same direction. The angle α may be substantially equal to 20°. The ribbons 32 may extend transversally between the front edge 20 and the rear edge 22, without contacting the securing portion 32.

Figure 12B:
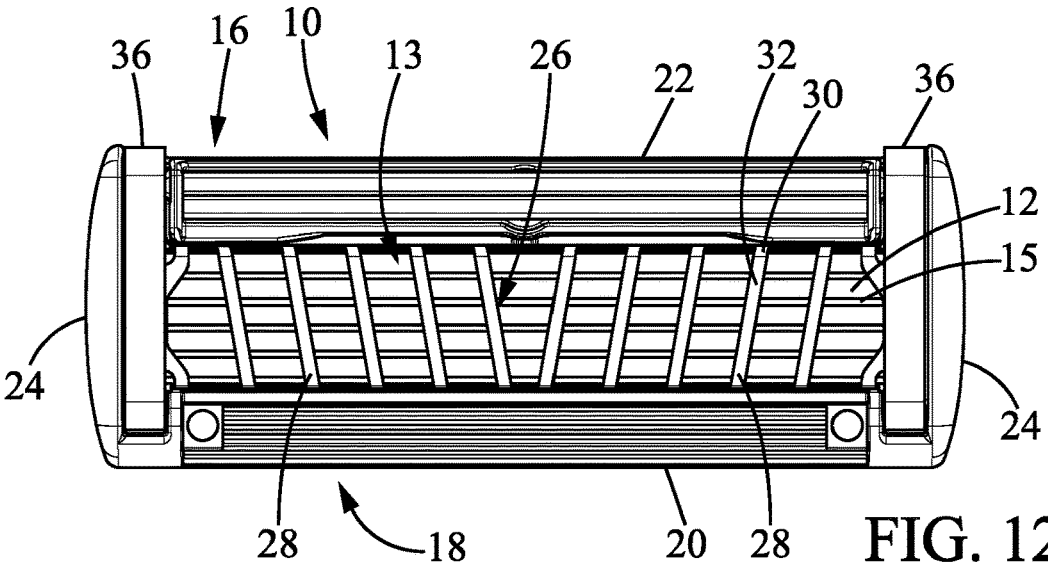
Figure 12C:
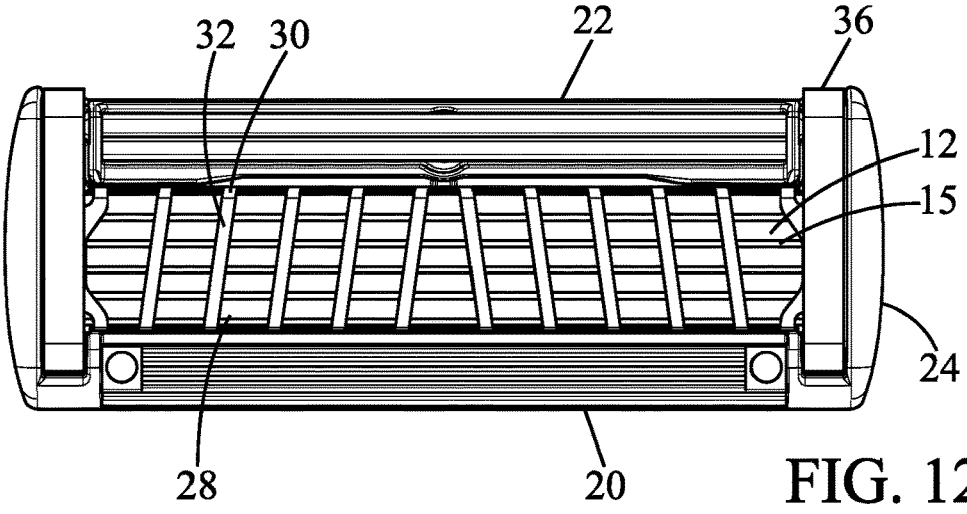

In FIGS. 12*b* and 12*c*, all the ribbons 32 may be oblique but not oriented in the same direction. The masking foil 26 may be symmetrically separated in its middle, for instance, in the direction from one side edge to the other side edge 24. The first half of the ribbons 32, i.e. the ribbons 32 between the first side edge 24 and the middle of the masking foil 26 may be inclined in a direction whereas the second half of the ribbons 32, i.e. the ribbons 32 between the middle of the masking foil and the second side edge 24, may be inclined with the same angle α but in an opposite direction. The ribbons 32 may extend transversally between the front edge 20 and the rear edge 22, without contacting the securing portion 32.

Figure 12D:
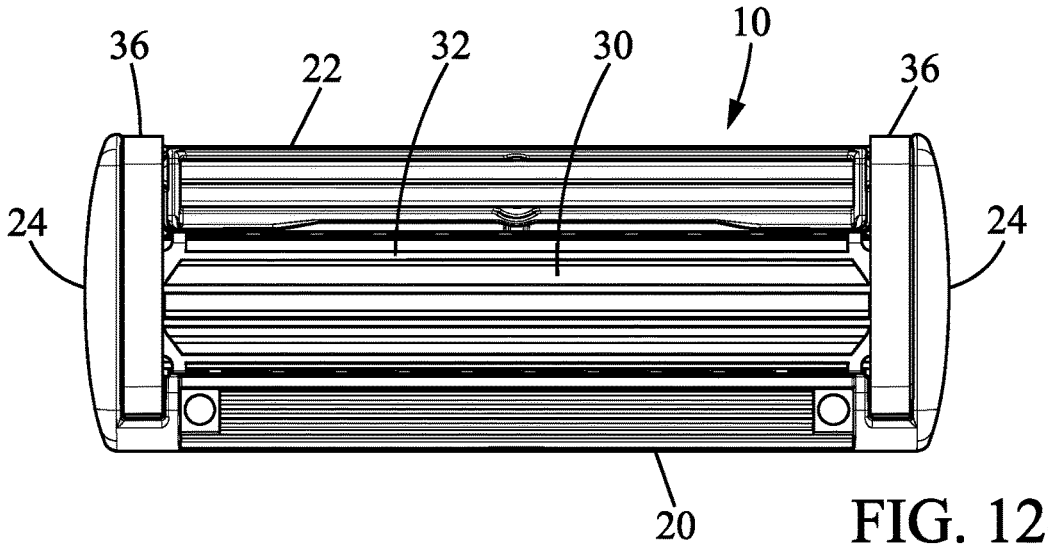

In FIG. 12*d*, the ribbons 32 may extend transversally between the two side edge 24.

Figure 12E:
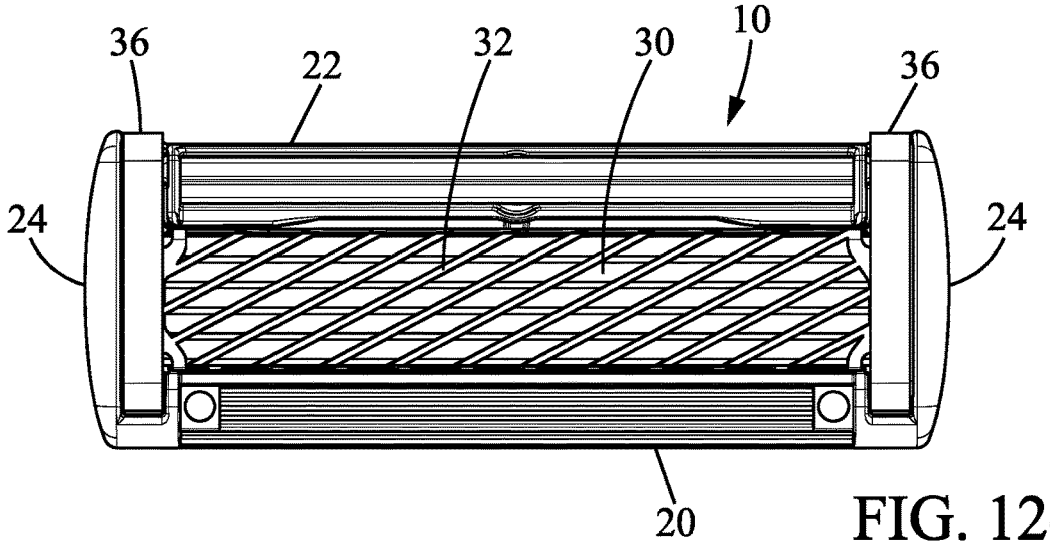

In FIG. 12*e*, all the ribbons 32 may be oriented in the same direction. The ribbons 32 may extend transversally between the front edge 20 and the rear edge 22. The ribbons 32 closest to the side edge 24 may contact the securing portion 32.

Figure 12F:
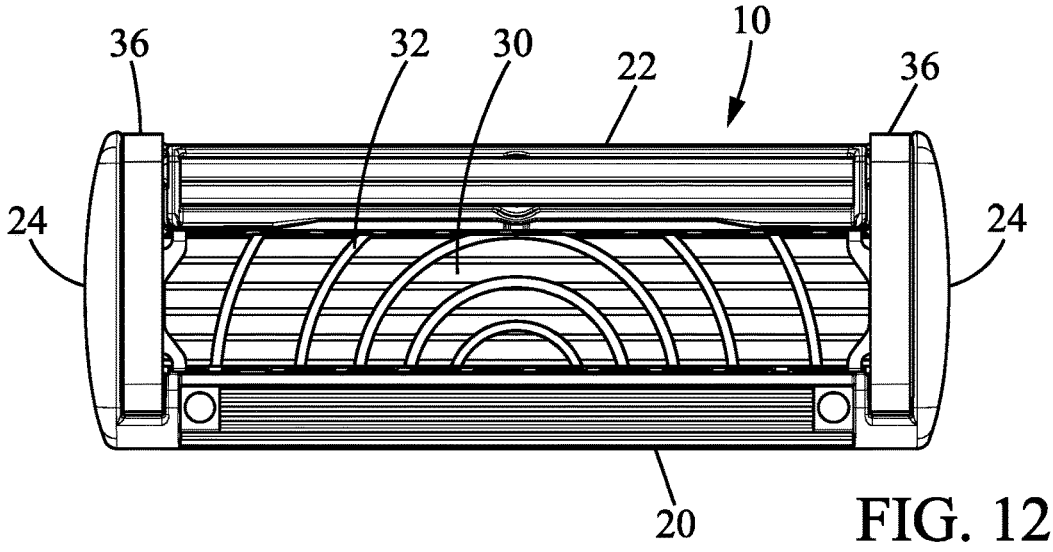

In FIG. 12*f*, the ribbons 32 may be oriented according a circumferential direction. Thus, the shortest ribbon may extend from and to the front edge 20. The longest ribbon may extend between the frond edge 20 and the rear edge 22.

Actually, any combination of number of ribbons and of their inclination angle can be provided on the masking foil:

- each of the ribbons of a masking foil can be inclined in the same direction, with the same angle α,
- each of the ribbons of a masking foil can be inclined in the same direction, with different angles α from one ribbon to another one,
- some of the ribbons of a masking foil can be inclined in opposite directions, with the same angle α,
- some of the ribbons of a masking foil can be inclined in opposite directions, with different angles α from one ribbon to another one, etc.

Thus, the pattern of the masking foil can manage the direction of the hairs in relation to the cutting edge. The oblique ribbons 32 provide hair cutting effect which improves shaving comfort during shaving.

Figure 12G:
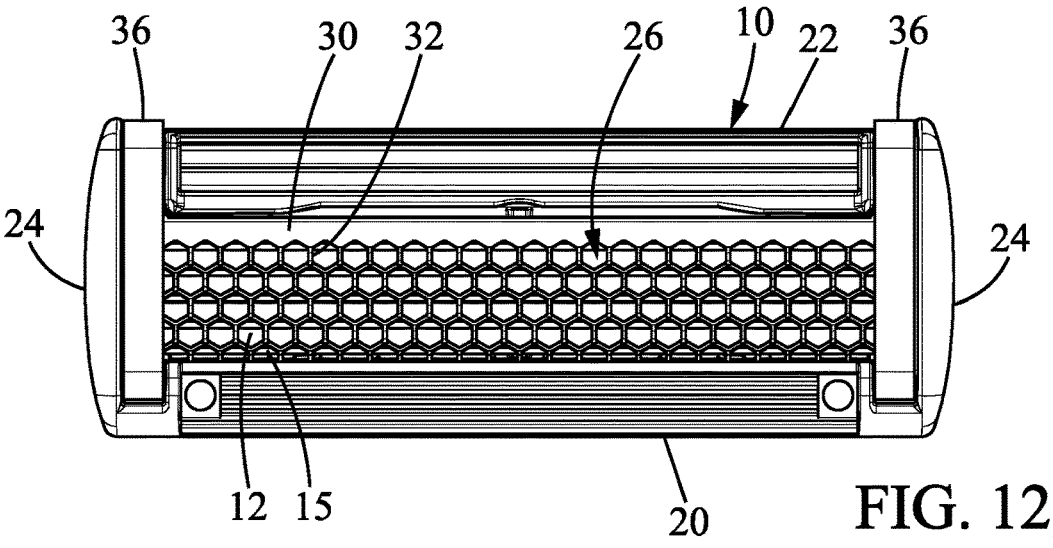
Figure 12H:
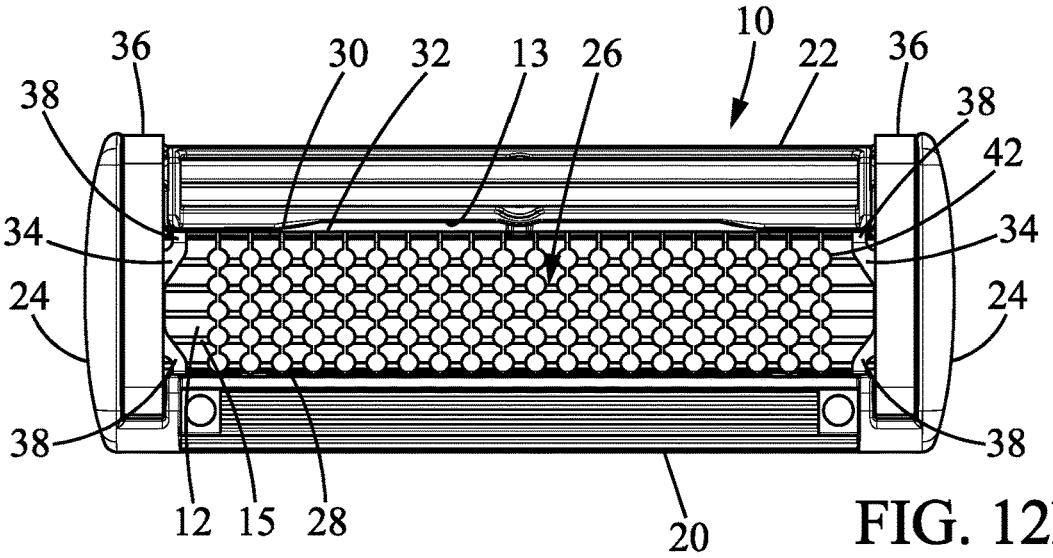
Figure 12I:
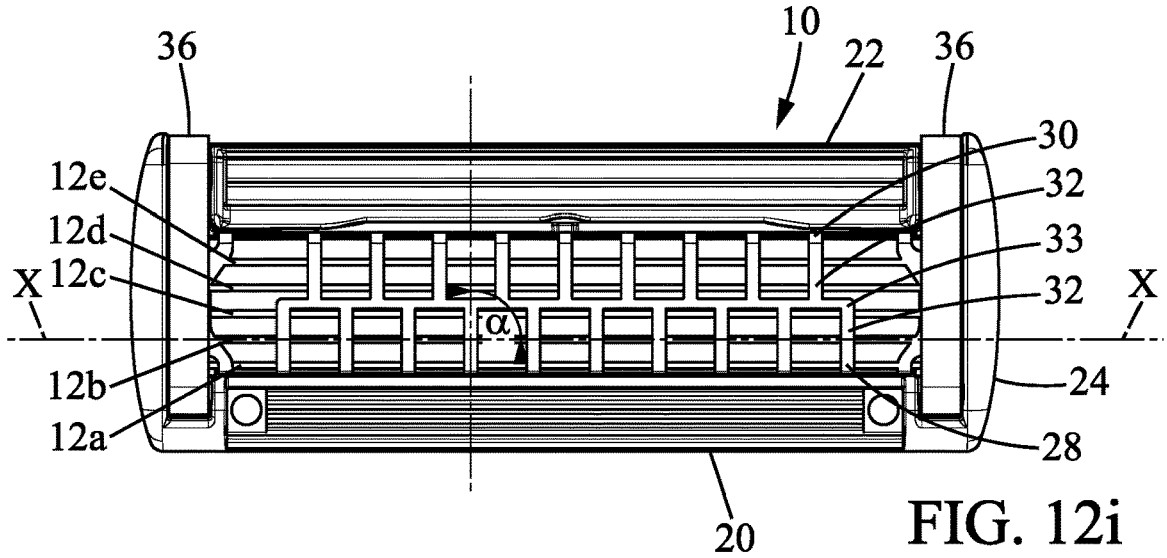

FIGS. 12*g* and 12*h* shows a masking foil 26 with particular ribbon patterns. Actually, as depicted in FIG. 12*g*, the ribbons 32 form a skin contacting surface with a hexagonal configuration, like a honeycomb. In FIG. 12*h*, ribbons 32 do not have a straight form. The ribbons 32 may comprise several circular shapes 42. The pattern of shapes 42 can also be rhomboidal.

In another example, as depicted in FIG. 12*i*, the shaving cartridge 10 comprises a masking foil 26 comprising an intermediate portion 33. The intermediate portion may extend in parallel to the front edge 20 and the rear edge 22. Each ribbon 32 may extend transversally from the front portion 28 or the back portion 30 to the intermediate portion 33. In this configuration, the angle α may be approximatively 90°. The ribbons 32 which may extend from the front portion 28 to the intermediate portion 33 may be staggered with respect to the ribbons which may extend from the back portion 30 to the intermediate portion 33.

In addition any combination of the configurations or patterns described above may be possible. The masking foil 26 can further comprise stainless steel. It can also comprise a material chosen among plastic material, composite, aluminum, aluminum alloys and/or noble metals chosen among gold or platinum. Metals such as aluminum and its alloys may improve corrosion and oxidation resistance of the blades 12 through anodic protection process. Thus, since the blade retainer 36, which may comprise aluminum, may no longer contacting blades 12, the masking foil may play the role of anodic protection.

In order to enhance functionality of the masking foil, it can comprise a wound healing and/or an anti-bacterial agent. The masking foil can also comprise a lubricating coating, such as hydrophobic or hydrophilic, such as polyfluorocarbon, for example polytetrafluoroethylene (PTFE), or hydrogel coating. This coating provides a reduction of the friction between the shaving cartridge and the skin.

The masking foil can also have color properties. For instance, different colors can be provided on the masking foil in order to distinguish the male or female utilization. For instance, the masking foil can be blue when intended to a man shaving razor, and red or pink when intended to a woman shaving razor.

The masking foil can also be provided with a material which has properties allowing a changing of the color after a particular number of uses. For instance, the masking foil can be green when never utilized and red when worn.

In another example not shown in figures, in order to improve adaptability of the masking foil 26 on skin contours, the masking foil 26 may be placed above the top surface 16 of the shaving cartridge 10. The bent portions 29, 30 may be wrapped around the front edge 20 and the rear edge 22, extending toward the bottom surface 18 of the shaving cartridge. The masking foil 10 may act as a blade retainer 36.

The description of the disclosure above is made in relation with a shaving cartridge 10 comprising one or several blades 12 provided in a housing 13, in which the blade(s) 12 can be movably or fixedly retained in the housing 13. But the disclosure is not limited to the previous features. The following examples can also apply to the masking foil of the disclosure.

Figure 13:
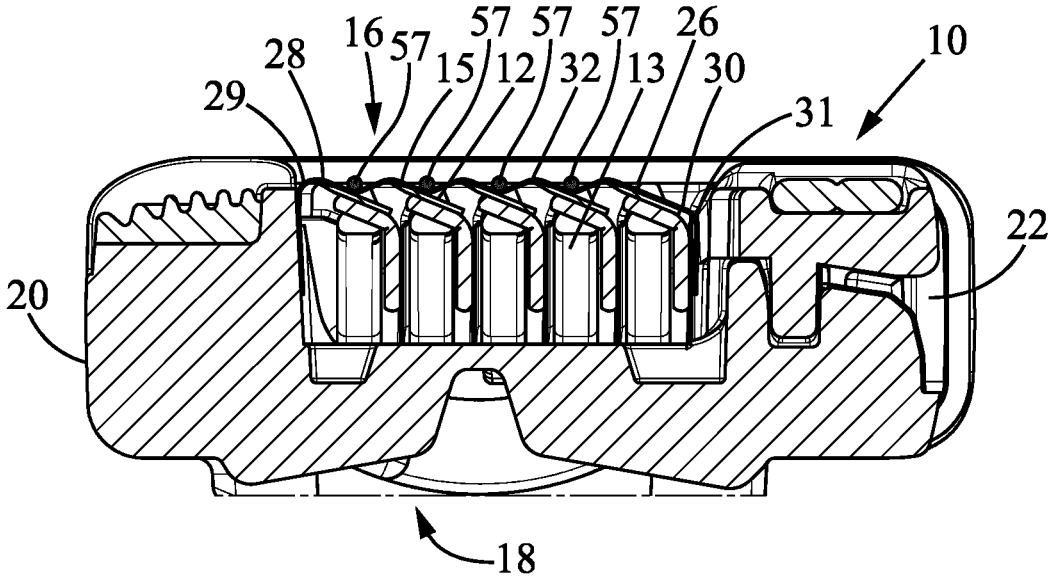
FIGS. 13 to 23 are illustrations of other examples of masking foil.

In an example, illustrated in FIG. 13, the corrugations of the masking foil, as depicted in FIG. 9*c* may comprise a lubricant or a shaving aid element. More precisely, the lubricant or the shaving aid element may be located on each concavity 57 of the corrugations. The height of the lubricant or the shaving aid element may be up to 1.0 mm, improving glideness of the shaving razor 10 on the skin during shaving and reducing skin bulge, nicks and cuts during shaving. When the lubricant or the shaving aid element is a hydrophobic material, the rinsability of the masking foil 26 may be improved.

Figure 14:
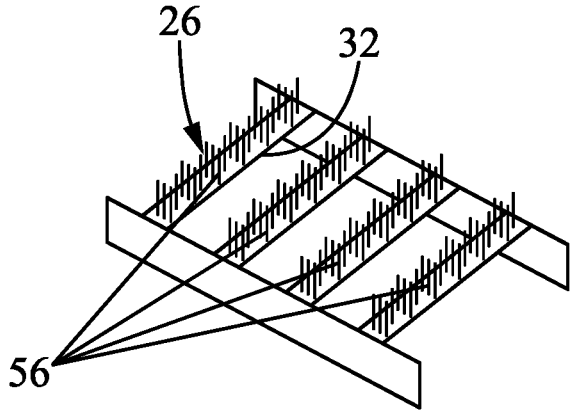

In another example, illustrated in FIG. 14, the ribbons 32 may comprise bristles 56. The bristles 56 may be flexible. The bristles 56 may have rounded tips. The height of the bristles 56 may be up to 0.6 mm, may be spaced at least about 0.3 mm from a next adjacent bristle 56 and may have a width defined at the respective root at least about 0.1 mm. The bristles 56 can move during shaving. The bristles 56 may face the top surface 16. The bristles 56 may provide a soft contact with the skin during shaving, a massage of the skin during shaving.

Figure 15:
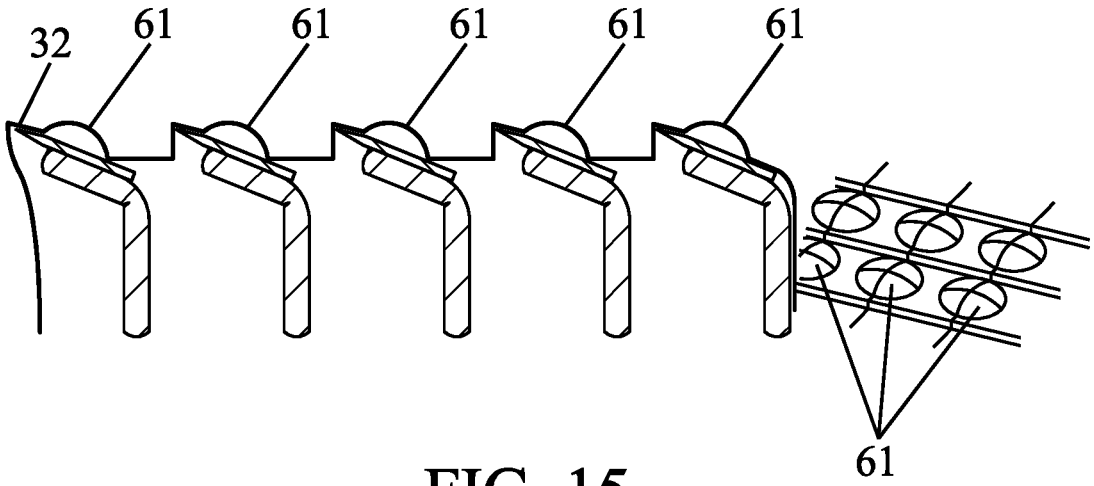

In another example, illustrated in FIG. 15, the ribbons 32 may comprise sphere shaped protrusions 61. The sphere shaped protrusions 61 may face toward the top surface 16. The height of the sphere shaped protrusions 61 may be up to 0.6 mm. The sphere shaped protrusions 61 may provide a massage of the skin during shaving.

Figure 16:
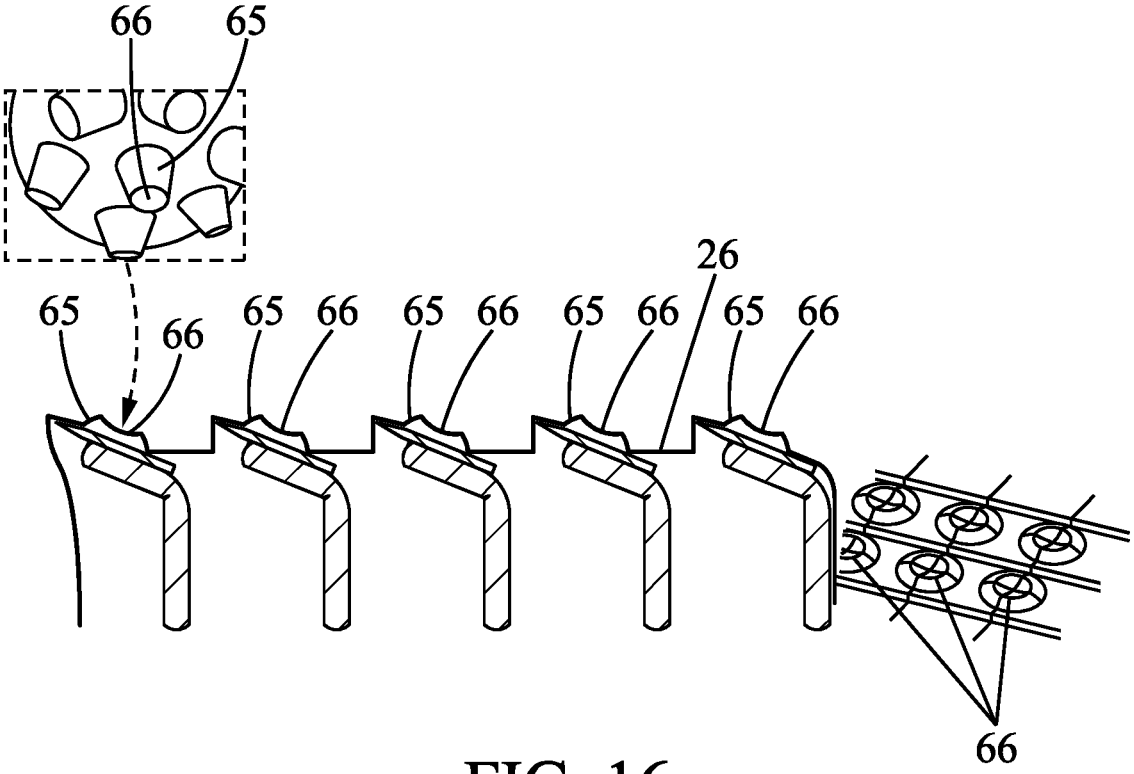

In another example, illustrated in FIG. 16, the ribbons 32 may comprise extruded protrusions 65. The extruded protrusions may have a rectangular or a conical shape. The conical shape ends with an aperture 66. The extruded protrusions 65 may face toward the top surface 16. The extruded protrusions 65 may comprise lubricant or shaving aid, which may be stored in the apertures 66. In addition, an electrical current can go through the masking foil 26, the extruded protrusions 65 may be heated and the release rate of the lubricant or shaving aid may be increased. In another example, the extruded protrusions 65 may be covered by a polymer film. An electrical current can go through the masking foil 26, the electrical current may control the porosity of the polymer film, the pores of the polymer film may expand and the release rate of the lubricant or the shaving aid from the apertures 66 may be increased. All the above-mentioned examples may improve hair removal and reduce irritations during shaving.

In another example, the masking foil 26 may have an organic pattern. The organic pattern may have the advantage to follow the skin contours and to guide the hair smoothly, providing a better hair alignment, smoother shaving and better hair removal.

Figure 17:
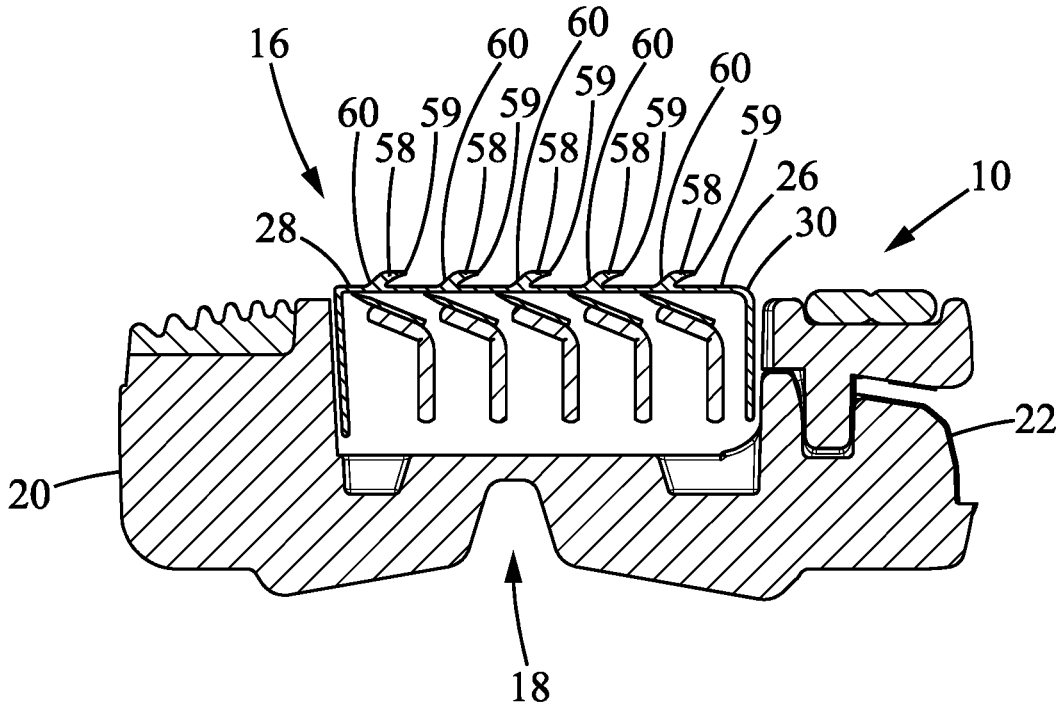

In another example, illustrated in FIG. 17, the ribbon 32 may comprise pikes 58 as shark fins. The tip 59 of the pikes 58 may be oriented towards the back portion of the masking foil. The pikes 58 may be oriented toward the top surface 16. The base 60 of the pikes 58 may be oriented towards the front portion 28 of the masking foil 26. The height of pikes 58 may be up to 0.6 mm. The pikes 58 may provide a mechanical exfoliation of the skin, as a pre-shave skin preparation phase. In addition, the pikes 58 may provide a dermo-dynamic feature, improving glideness of the shaving razor 10 on the skin during shaving.

Figure 18:
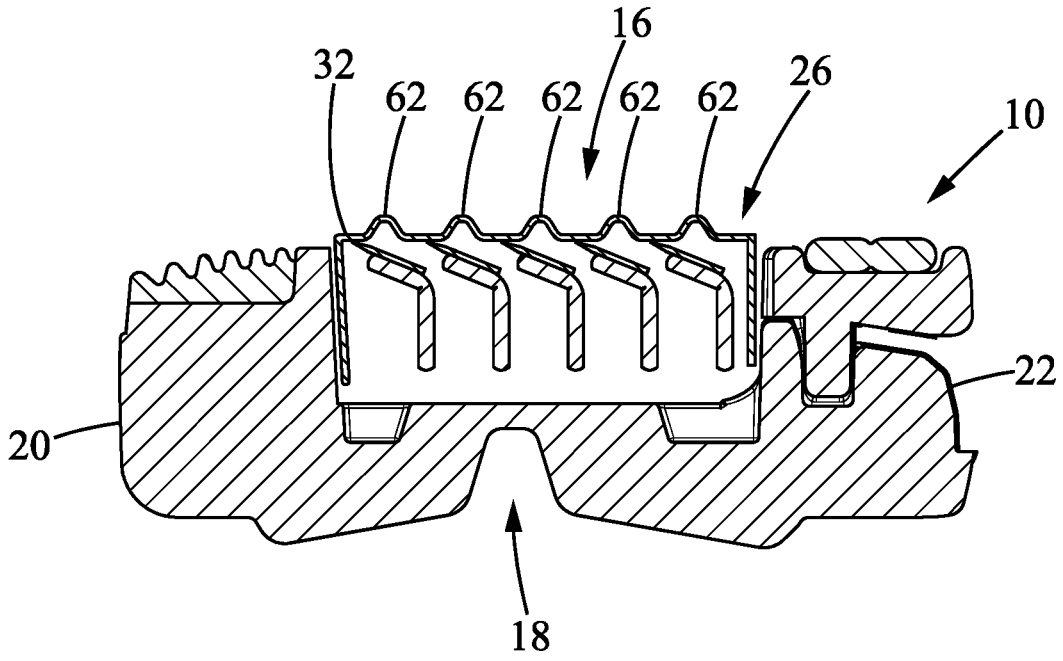

In another example, illustrated in FIG. 18, the ribbons 32 may comprise rounded protrusions 62. The rounded protrusions 62 may face toward the top surface 16 of the housing. The height of the rounded protrusions 62 may be up to 0.6 mm. The rounded protrusions 62 may eliminate the bulging effect that may happen during the shaving.

In another example, when the masking foil 26 is not fixedly mounted in the housing and does not cover partially the cutting edge 15 of all the blades 12, for example as illustrated in FIG. 6, the blades 12 that are uncovered by the masking foil 26 can be movable, or fixedly mounted in the housing 13. Moreover, the cutting edges 15 may have different exposure, between −200 μm to +200 μm. In addition, the masking foil 26 may improve hair removal and reduce nicks and cuts during shaving.

In another example, illustrated in FIG. 19, the shape surface of the masking foil 26 may be corrugated. The tip 63 of each corrugation may be sharp. Each corrugation 63 can be used for stabilizing and regulating the angle of each blade 12. The angle (also called shaving angle) may be the angle between the upper surface of the blade 12 and the shaving plane S at rest position (non-shaving). The shaving angle may be between 5° and 30°. The shaving angle of each blade may be the same, totally different, progressive or any combination thereof. For example, when the shaving cartridge 10 comprises five blades, the shaving angle θ1 of the first blade 12*a* may be smaller than the shaving angle θ2 of the second blade 12*b*. Likewise, the shaving angle θ2 of the second blade 12*b* may be smaller than the shaving angle θ3 of the third blade 12*c*. The blade angle θ3 of the third blade 12*c* may be smaller than the shaving angle T4 of the fourth blade 12*d*. The shaving angle θ4 of the fourth blade 12*d* may be smaller than the shaving angle θ5 of the fifth blade 12*e*. In another example, illustrated in FIG. 20, each corrugation may comprise two tips 63. The first tip 63*a* may correspond to the cutting edge 15 of the blade 12 located below. The second tip 63*b* may correspond to an additional tip located above the blade 12. This masking foil may reduce the total number of strokes during shaving. In another example, illustrated in FIG. 21, the shape surface of the masking foil 26 may be corrugated. The corrugations 64 may be located on the side of the front portion 28 of the masking foil 26. In further aspects, the corrugations 64 may dispersed in another part or in the whole surface of the masking foil 26. Actually, each corrugation 64 has an amplitude different from each other. The amplitude may be up to 0.6 mm. For example, the amplitude A1 of the corrugation 64 of the first blade 12*a* may be larger than the amplitude A2 of the corrugation 64 of the second blade 12*b*. Likewise, the amplitude A2 of the corrugation 64 of the second blade 12*b* may be larger than the amplitude A3 of the corrugation 64 of the third blade 12*c*. The amplitude A3 of the corrugation 64 of the third blade 12*c* may be larger than the amplitude A4 of the corrugation 64 of the fourth blade 12*d*. The amplitude A4 of the corrugation 64 of the fourth blade 12*d* may be larger than the amplitude A5 of the corrugation 64 of the fifth blade 12*e*. In the example depicted, the amplitude A5 may be null. In another example, each corrugation 64 may press each blade differently. Each blade 12 may have different or a progressive exposure, between −200 μm to +200 μm. For example, the first corrugation 64 of the first blade 12*a* may press the first blade 12*a* creating a negative geometry. Simultaneously, the second corrugation 64 of the second blade 12*b* may press the second blade 12*b* a little bit lower than the first and so on, till the fifth blade 12*e*. In another example, the masking foil 26 may not comprise corrugations 64 above the forth blade 12*d* and/or the fifth blade 12*e*. In this example, the masking foil may not press the forth 12*d* and/or the fifth blade 12*e*. The forth 12*d* and/or the fifth blade 12*e* may have different geometry than the first blade 12*a*, second blade 12*b* and the third blade 12*c*. The corrugations 64 may reduce the shaving cartridge to skin friction, reduce skin bulge and improve hair alignment during shaving.

Figure 22:
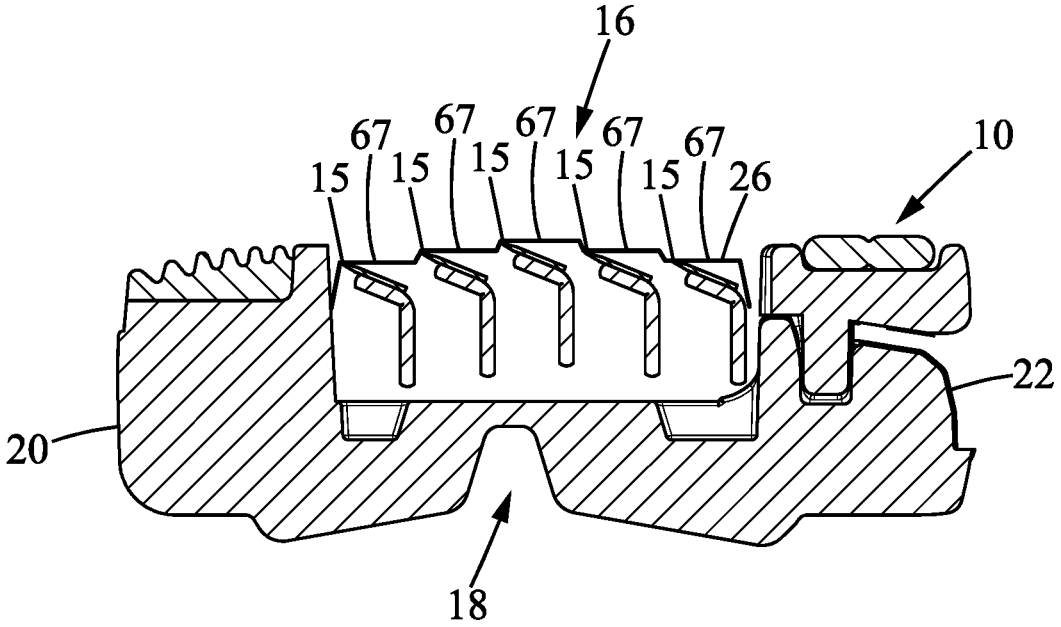

In another example, illustrated in FIG. 22, the ribbon 32 may form a kind of step 67. Actually, the ribbon 32 may comprise as many steps 67 as blades 12. The steps 67 may provide a better shaving on difficult areas of skin, for example the chin, reduce nicks and cut irritations during shaving.

Figure 23:
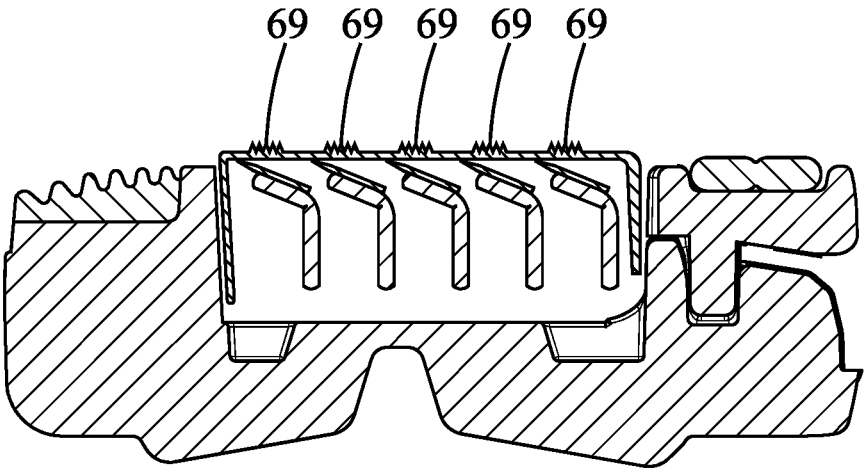

In another example, illustrated in FIG. 23, the ribbons 32 may comprise small barbs. The small barbs may be split into clumps 69 along the ribbon 32. The height of the clumps 69 may be up to 0.6 mm and the distance between two adjacent clumps 69 may be more that 0.1 mm. The small barbs may provide a mechanical exfoliation of the skin. For example, the mechanical exfoliation may be a sebum removal.

Figure 20:
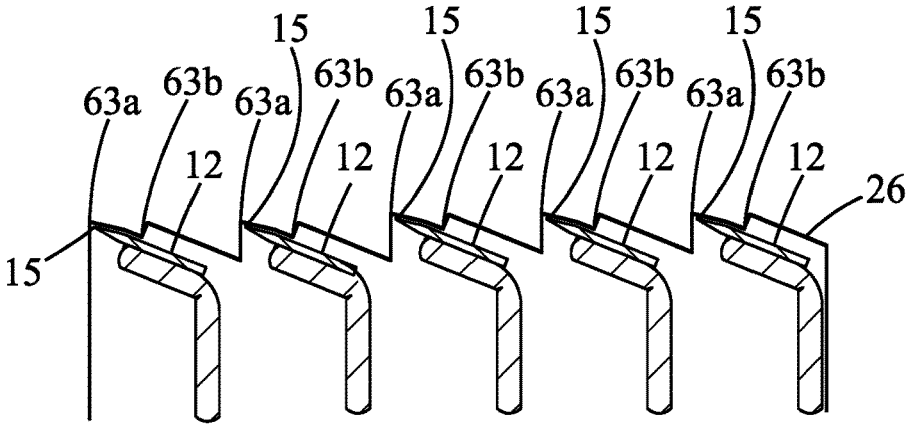
Figure 21:
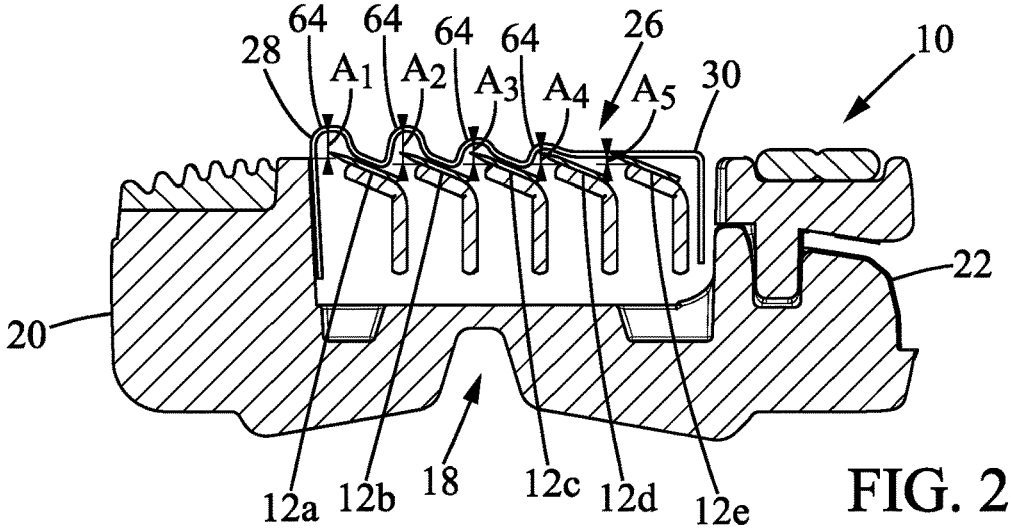

A masking foil 26 for a shaving cartridge (10), as shown for example in FIG. 3, can be made by using several methods, such as photo etching, laser cutting, stamping, electrical discharge machining, water jet cutting or electroforming. For example, the masking foil can be made of a flat strip of material. The strip has an upper portion and a lower portion. The material is chosen among plastic material, composite, aluminum, aluminum alloys and/or noble metals chosen among gold or platinum. The strip material may pass through a stamping station performing holes in the strip, forming the pattern of the masking foil 26, as shown in FIG. 10*a*. After stamping station the masking foil 26 may pass through a bending station. The bending station may comprise a slot which receives the strip. The upper portion and the lower portion of the strip project outside of the slot. The upper portion and the lower portion may be bent inwardly about a bending axis, forming a front bent portion 29 and a back bent portion 31 of the masking foil. The front bent portion 29 and the back bent portion 31 of the masking foil 26 may have the same or different radius of curvature. The radius of curvature can be range between 0.10 mm to 0.70 mm. In another example, an elastic means 40 may be formed between the front bent portion 29 and the anchorage area 29*b* of the masking foil 26 as visible in FIGS. 10*a* and 10*b*. The elastic means 40 can for example be a spring. An elastic means 40 can also be formed between the back bent portion 31 and the anchorage area 31*b*. In another example, the lower portion of each anchorage area 29*b*, 31*b* may be bent outwardly forming a portion which may fit into each slot 13*a*, 13*b*, as shown in FIGS. 10*b* and 10*c*. In another example, the side edges of each ribbon 32 may be grinded or electrochemically etched, providing additional cutting edges of different profiles as shown in FIGS. 19, 20.

The invention claimed is:

1. A shaving cartridge comprising:

a housing, at least one masking foil, and at least one retainer;

the housing including a top surface, a bottom surface, a front edge, a rear edge, and a pair of side edges extending between the front edge and the rear edge; and at least one blade, wherein the at least one blade includes a first blade disposed between the front edge and the rear edge of the housing, the first blade having a first cutting edge extending toward the top surface of the housing, the first blade being movable in the housing;

the at least one masking foil including a front portion located forward of the first cutting edge of the first blade and a back portion located rearward of the first cutting edge of the first blade, the at least one masking foil including at least one ribbon which partially covers the first cutting edge of the first blade;

the at least one ribbon including a front bent portion connected to the front portion of the at least one masking foil and a back bent portion connected to the back portion of the at least one masking foil, the front and the back bent portions being directed toward the bottom surface of the housing; and the masking foil being inserted in the housing of the cartridge, wherein the masking foil is movable relative to the housing.

2. The shaving cartridge according to claim 1, wherein the at least one masking foil further includes at least one elastic portion, the at least one elastic portion including a first end connected to and extending from the front bent portion and the back bent portion, respectively, of the at least one ribbon, in a direction away from the top surface of the housing.

3. The shaving cartridge according to claim 2, wherein the at least one masking foil further includes an anchorage area, and the anchorage area is connected to and extends from a second end of the at least one elastic portion in a direction, respectively, away from the front and rear edges of the housing.

4. The shaving cartridge according to claim 1, wherein the at least one masking foil further includes at least one securing portion, the at least one securing portion extending between the front bent portion and the back bent portion, respectively, of the at least one ribbon, and is disposed adjacent to the first cutting edge of the first blade.

5. The shaving cartridge according to claim 4, wherein the at least one blade further includes a second blade, the second blade having a second cutting edge, the at least one ribbon partially covering both the first cutting edge and the second cutting edge, and wherein the securing portion is disposed adjacent to both the first cutting edge of the first blade and the second cutting edge of the second blade.

6. The shaving cartridge according to claim 1, wherein the at least one blade further includes a second blade, the second blade having a second cutting edge, wherein the at least one ribbon partially covers the first cutting edge, and the second cutting edge is uncovered by the at least one ribbon.

7. The shaving cartridge according to claim 1, wherein the at least one ribbon includes bristles, and the bristles are flexible and adapted to move during shaving.

8. The shaving cartridge according to claim 1, wherein the at least one ribbon comprises protruding features or portions facing toward the top surface of the housing, and the protruding features or portions are conical in shape and include an aperture.

9. The shaving cartridge according to claim 1, wherein the at least one ribbon comprises protruding features or portions facing toward the top surface of the housing, and the protruding features or portions includes (1) pikes or fins having a tip that is oriented toward the top surface of the housing, (2) corrugations, (3) a plurality of steps, or (4) a plurality of a series of small barbs, the plurality of the series of small barbs being spaced along the at least one ribbon.

10. The shaving cartridge according to claim 1, wherein the at least one masking foil includes a wound healing or an anti-bacterial agent.

11. The shaving cartridge according to claim 1, wherein the at least one masking foil includes a lubricating coating.

12. The shaving cartridge according to claim 1, wherein the at least one blade includes a plurality of blades, and wherein the at least one masking foil includes a first masking foil and a second masking foil, the first masking foil and the second masking foil being separated by at least one of the plurality of blades.

13. The shaving cartridge according to claim 1, wherein:

the at least one retainer includes a body extending between a first leg of the at least one retainer and a second leg of the at least one retainer, and further the first leg and the second leg being transverse to the body, and the first leg of the at least one retainer wraps around and surrounds a portion of the housing, and the second leg of the at least one retainer is received in a through hole provided in the housing to retain the first blade in the housing.

14. The shaving cartridge according to claim 1, wherein the at least one blade further includes a second blade, a third blade, a fourth blade, and a fifth blade, each having respective cutting edges disposed rearward of the first blade, wherein the at least one masking foil partially covers the first cutting edge of the first blade, and respective cutting edges of the second blade and the third blade, wherein respective cutting edges of the fourth blade and the fifth blade are disposed rearward of the back portion of the at least one masking foil such that the respective cutting edges of the fourth blade and the fifth blade are not covered by the at least one masking foil.

15. The shaving cartridge according to claim 1, wherein:

the at least one blade includes a second blade having a second cutting edge disposed rearward of the first blade;

the at least one masking foil is a first masking foil that partially covers the first cutting edge of the first blade and does not cover the second cutting edge of the second blade;

the at least one masking foil includes a second masking foil that partially covers the second cutting edge of the second blade and does not cover the first cutting edge of the first blade; and the first blade and the second blade are directly adjacent blades within the shaving cartridge.

16. The shaving cartridge according to claim 1, wherein:

the at least one blade further includes a second blade, a third blade, a fourth blade, and a fifth blade, each having a respective cutting edge disposed rearward of the first cutting edge of the first blade, the at least one masking foil is a first masking foil that partially covers the first cutting edge of the first blade, and respective cutting edges of the second blade and the third blade, and does not cover respective cutting edges of the fourth blade and the fifth blade;

the at least one masking foil includes a second masking foil that partially covers the respective cutting edges of the fourth blade and the fifth blade, and does not cover the first cutting edge of the first blade, or the respective cutting edges of the second blade and the third blade; and the third blade and the fourth blade are directly adjacent to each other within the shaving cartridge.

17. The shaving cartridge according to claim 1, wherein the at least one ribbon includes a plurality of ribbons, wherein each of the plurality of ribbons includes a front bent portion connected to the front portion of the at least one masking foil and a back bent portion connected to the back portion of the at least one masking foil, the front and the back bent portions being directed toward the bottom surface of the housing; and each of the plurality of ribbons includes protruding features or portions facing toward the top surface of the housing.

18. The shaving cartridge according to claim 1, wherein an entirety of the at least one masking foil is movable relative to the housing.

19. The shaving cartridge according to claim 1, wherein the at least one ribbon comprises protruding features or portions facing toward the top surface of the housing.

* * * * *